US006366291B1

(12) United States Patent
Taniguchi et al.

(10) Patent No.: US 6,366,291 B1
(45) Date of Patent: Apr. 2, 2002

(54) METHOD OF COLOR CONVERSION, APPARATUS FOR THE SAME, AND COMPUTER PROGRAM PRODUCT FOR REALIZING THE METHOD

(75) Inventors: Kazutaka Taniguchi; Takashi Sakamoto; Makoto Narazaki, all of Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 0 days.

(21) Appl. No.: 09/113,616

(22) Filed: Jul. 10, 1998

(30) Foreign Application Priority Data

Jul. 17, 1997 (JP) ..... 9-209756
Jul. 22, 1997 (JP) ..... 9-212503

(51) Int. Cl.[7] ..... G09G 5/02
(52) U.S. Cl. ..... 345/603; 345/600
(58) Field of Search ..... 345/150, 153, 345/154, 147, 600, 604, 603, 593; 348/34, 32, 582, 659; 358/523, 515, 518, 520

(56) References Cited

U.S. PATENT DOCUMENTS 4,985,853 A * 1/1991 Taylor et al. ..... 345/154
5,448,379 A * 9/1995 Ishihara et al. ..... 358/518
5,767,992 A * 6/1998 Tanaka et al. ..... 358/520
5,809,213 A * 9/1998 Bhattacharjya ..... 358/523 X
5,909,291 A * 6/1999 Myers et al. ..... 358/523
6,072,464 A * 6/2000 Ozeki ..... 345/154
6,081,254 A * 6/2000 Tanaka et al. ..... 345/603
6,323,969 B1 * 11/2001 Shimuzu et al. ..... 358/523

* cited by examiner

*Primary Examiner*—Matthew Luu
*Assistant Examiner*—Chant' Harrison
(74) *Attorney, Agent, or Firm*—Ostrolenk, Faber, Gerb & Soffen, LLP

(57) ABSTRACT

A CPU 20 assumes a virtual color monitor in which actual chromaticity coordinates of colors expressed by fluorescent materials are replaced by virtual chromaticity coordinates having the same hues as those of the actual chromaticity coordinates but higher saturations than those of the actual chromaticity coordinates. The CPU 20 converts colorimetric values X, Y, and Z into luminance-linear values r', g', and b' for red, green, and blue, based on a relationship of color conversion for the virtual color monitor at step S23. The CPU 20 then sets any one of the values r', g', and b' to L at step S24 and compares the value L with i at step S26, where i is the γ-th power of j and greater than 0. In case that the value L is less than i, the CPU 20 calculates a value c based on the remaining values other than the value L among the values r', g', and b' at step S27. When $-ck \leqq L < 0$, conversion of the value L into V is carried out according to a linear function of L, in which an L intercept is varied with a variation of the value c, at step S28. In case that the value L is not less than i, on the other hand, the CPU 20 carries out conversion of the value L into V according to a function of 1/γ-th power of L at step S30. At subsequent step S32, the CPU 20 sets the value V thus obtained to one of display signals R, G, and B corresponding to one of the values r', g', and b' set at step S24. This color conversion process effectively prevents abnormal tone or a change in hue in an area of a desired color that is out of a reproducible color range.

6 Claims, 21 Drawing Sheets

Fig. 9(a)

| | x | y |
|---|---|---|
| red | 0.640 | 0.330 |
| green | 0.300 | 0.600 |
| blue | 0.150 | 0.060 |

Fig. 9(b)

| | x | y |
|---|---|---|
| white | 0.345619 | 0.3585675 |

Fig. 10

| | x | y | Y | L* | a* | b* |
|---|---|---|---|---|---|---|
| red | 0.640 | 0.330 | 24.99 | 57.07 | 82.64 | 65.59 |
| green | 0.300 | 0.600 | 69.80 | 86.90 | -87.17 | 73.33 |
| blue | 0.150 | 0.060 | 5.21 | 27.33 | 69.84 | -113.33 |
| white | 0.3456 | 0.3585 | 100.00 | 100.00 | 0.00 | 0.00 |

Fig. 11

| | x | y | Y | L* | a* | b* |
|---|---|---|---|---|---|---|
| red | 0.650 | 0.325 | 24.94 | 57.07 | 86.77 | 68.86 |
| green | 0.295 | 0.613 | 70.18 | 86.90 | -91.53 | 77.00 |
| blue | 0.145 | 0.052 | 4.87 | 27.32 | 73.30 | -119.00 |
| white | 0.3456 | 0.3585 | 100.00 | 100.00 | 0.00 | 0.00 |

Fig. 22

| R | G | B | C | M | Y | K |
|---|---|---|---|---|---|---|
| 0 | 0 | 0 | $C_1$ | $M_1$ | $Y_1$ | $K_1$ |
| 0 | 0 | 8 | $C_2$ | $M_2$ | $Y_2$ | $K_2$ |
| 0 | 0 | 16 | $C_3$ | $M_3$ | $Y_3$ | $K_3$ |
| | ⋮ | | | ⋮ | | |
| 0 | 0 | 255 | $C_{m-1}$ | $M_{m-1}$ | $Y_{m-1}$ | $K_{m-1}$ |
| 0 | 8 | 0 | $C_m$ | $M_m$ | $Y_m$ | $K_m$ |
| 0 | 8 | 8 | $C_{m+1}$ | $M_{m+1}$ | $Y_{m+1}$ | $K_{m+1}$ |
| | ⋮ | | | ⋮ | | |
| 0 | 255 | 255 | $C_{n-1}$ | $M_{n-1}$ | $Y_{n-1}$ | $K_{n-1}$ |
| 8 | 0 | 0 | $C_n$ | $M_n$ | $Y_n$ | $K_n$ |
| 8 | 0 | 8 | $C_{n+1}$ | $M_{n+1}$ | $Y_{n+1}$ | $K_{n+1}$ |
| | ⋮ | | | ⋮ | | |
| 255 | 255 | 255 | $C_p$ | $M_p$ | $Y_p$ | $K_p$ |

METHOD OF COLOR CONVERSION, APPARATUS FOR THE SAME, AND COMPUTER PROGRAM PRODUCT FOR REALIZING THE METHOD

BACKGROUND OF THE INVENTION

1. Field of the Invention

The present invention relates to a technique of converting colorimetric values to display signals input into a color display device and a technique of inversely converting the display signals to the colorimetric values.

2. Description of the Related Art

A conventional technique reads an original color image, for example, from a color film, color photographic paper, or a color print, with a color scanner, obtains three color signals of R (red), G (green), and B (blue) corresponding to the input original color image, and gives the obtained RGB color signals to a color monitor to display a color image in an interactive manner for the purpose of checking the input color image or carrying out the required processing.

The RGB color signals read with the color scanner depend upon only the characteristics of a color separation filter of the color scanner. Transmission of the RGB color signals to the color monitor without any processing accordingly does not give a color image that is sufficiently close to the original color image.

In the field of image processing for prints and newspapers, four color inks C (cyan), M (magenta), Y (yellow), and K(black) are used for color printing. Each pixel of an original image for color printing is subjected to color conversion and consists of four color signals of C, M, Y, and K. In the intermediate stage of image processing, in order to preview an image being processed or an expected final image, the CMYK color signals for color printing are converted into the RGB color signals and given to the color monitor for display of a color image.

Simple conversion of the CMYK color signals for color printing to the RGB color signals and transmission of the converted RGB color signals to the color monitor, however, does not give a color image that is sufficiently close to an actual color printed image.

The RGB color signals depending upon only the characteristics of the color separation filter or the CMYK color signals for color printing should be subjected to color conversion to RGB color signals for a target color monitor. Such conversion process enables a desired color image to be displayed on the color monitor.

The color monitor can display only the colors included in a color range defined by fluorescent materials of three colors, red, green, and blue (that is, in the gamut intrinsic to the color monitor), whereas the gamut of an original color image or the gamut of a color printed image often includes colors that are located out of the color range defined by the fluorescent materials of three colors (red, green, and blue) of the color monitor.

When the values of the RGB color signals for the color monitor obtained by the color conversion are normalized in the range of 0 to 1, at least one signal out of the RGB color signals for the color monitor has a value of less than 0 (that is, a negative value) or a value of greater than 1 (that is, a value exceeding 100%), with respect to the colors located out of the color range defined by the fluorescent materials of three colors (red, green, and blue) of the color monitor.

Normalization of the values of the RGB color signals for the color monitor in the range of 0 to 1 implies that the values of the RGB color signals required for expression of white on the color monitor are respectively set equal to 1 (that is, the maximum value) and that the values of the RGB color signals required for expression of black on the color monitor are respectively set equal to 0 (that is, the minimum value). The fluorescent material can not accordingly emit at the values of greater than 1 or at the values of less than 0.

In such cases, the conventional technique limits the values of the RGB color signals for the color monitor to the maximum value '1' or the minimum value '0' even when the values of greater than 1 or the values of less than 0 are required as the values of the RGB color signals for the color monitor.

In case that a desired color included in an original color image or a color printed image is out of the color range reproducible by the fluorescent materials of the color monitor, the values of the RGB color signals for the color monitor are uniformly limited to the maximum value '1' or the minimum value '0' with respect to the desired color (for example, the color of high saturation). This arises a significant problem of abnormal tone in an area of the desired color.

In case that a desired color included in an original color image or a color printed image exists over the border of the inside and the outside of the color range reproducible by the fluorescent materials of the color monitor, all the values of the three color signals RGB are not uniformly limited to the maximum value '1' or the minimum value '0' on the border of the color range. Only the value of the color signal that is greater than the maximum '1' or is less than the minimum '0' is limited to the maximum value '1' or the minimum value '0', while the values of the other color signals continue variation. This causes the hue to abruptly change in the vicinity of the border of the color range.

The area of colors of high saturation is generally prominent in an image. The abnormal tone or the change in hue in such prominent areas often lead to a critical problem.

SUMMARY OF THE INVENTION

The object of the present invention is thus to provide a method of and an apparatus for color conversion, which effectively prevents abnormal tone or a change in hue in an area of a desired color that exists out of a reproducible color range.

At least part of the above and the other related objects is realized by a first method of color conversion, which converts colorimetric values of a composite color into mixing quantities of device primary colors in additive color mixture according to a first conversion relation and subsequently converts the mixing quantities of the device primary colors into intensities of display signals according to a second conversion relation, respectively. A relievable area that is out of and adjacent to a reproducible range and within a predetermined maximum relievable range is determined for at least one selected device primary color among the device primary colors as a function of the mixing quantities of the remaining device primary colors other than the selected device primary. When the mixing quantity of the selected device primary color is within the reproducible range, the mixing quantity of the selected device primary color is converted into the intensity of the display signal within the first conversion range preset in a definition range. When the mixing quantity of the selected device primary color is within the relievable range, on the other hand, the mixing quantity of the selected device primary color is converted into the intensity of the display signal within the second conversion range other than the first conversion range in the definition range.

The present invention is also directed to a first color conversion apparatus which converts colorimetric values representing a composite color into display signals that are to be input into a target color display device to reproduce the composite color, the display signals being related to mixing quantities of device primary colors in additive color mixture, the device primary colors being single-color components reproduced by respective single-color elements of the target color display device, the composite color being reproduced by the target color display device as a mixture of the device primary colors mixed by respective mixing quantities responsive to the display signals, the target color display device having a reproducible range of the mixing quantity for each of the device primary colors.

The first color conversion apparatus includes: means for defining a definition range of intensities of the display signals, wherein those display signals whose intensities are within the definition range are to be converted in the target color display device to the mixture quantities within the reproducible range, the definition range being divided into a first conversion range and a second conversion range; a first conversion unit which converts the colorimetric values of the composite color into the mixing quantities of the device primary colors according to a first conversion relation; and a second conversion unit which converts the mixing quantities of the device primary colors into the intensities of the display signals according to a second conversion relation, respectively. The second conversion unit determines a relievable range for at least one selected device primary color among the device primary colors as a function of the mixing quantities of the remaining device primary colors other than the selected device primary color, the relievable range being out of and adjacent to the reproducible range and within a predetermined maximum relievable range. When the mixing quantity of the selected device primary color is within the reproducible range, the second conversion unit converts the mixing quantity of the selected device primary color into the intensity of the display signal within the first conversion range. When the mixing quantity of the selected device primary color is within the relievable range, the second conversion unit converts the mixing quantity of the selected device primary color into the intensity of the display signal within the second conversion range.

With respect to a desired color that is out of the predetermined range reproducible by a color display device, when the mixing quantity of a selected device primary color among the mixing quantities of the device primary colors in additive color mixture, which are obtained by converting the colorimetric values of the desired color, is within the relievable range, the mixing quantity is converted into the intensity of the display signal that is within the second conversion range. This technique does not lose the information regarding the desired color, but keeps the information of the selected device primary color as the intensity of the display signal. This effectively prevents abnormal tone or a change in hue in the area of the desired color.

In accordance with one preferable application of the first method or the first color conversion apparatus, the first conversion relation represents conversion from the colorimetric values to mixing quantities of virtual device primary colors of a virtual color display device, the virtual color display device having virtual single-color elements reproducing virtual single-color components associated with the single-color components reproduced by the single-color elements of the target color display device, respectively, wherein at least one selected virtual single-color component is determined so that the selected virtual single-color component has an identical hue with that of the associated single-color component and a higher saturation than that of the associated single-color component.

Compared with the target color display device, the virtual color display device has an extended reproducible color range in the direction of higher saturation. Namely the virtual color display device can reproduce some colors that are not reproducible by the target color display device (more concretely, the colors of high saturation that are immediately out of the color range reproducible by the target color display device). The first method and the first color conversion apparatus of the present invention convert the colorimetric values into the mixing quantities of the device primary colors in additive color mixture, according to the converting relation specified for the virtual color display device. This technique maintains normal tone and interferes with a change in hue in the area of a desired color that is out of the color range reproducible by the target color display device but within the color range reproducible by the virtual color display device.

Part of the objects is also realized by a second method of color conversion, which converts intensities of display signals, which respectively correspond to device primary colors in additive color mixture, into mixing quantities of the device primary colors according to a first converting relation, respectively, and subsequently converts the mixing quantities of the device primary colors into colorimetric values according to a second converting relation. A relievable range that is out of and adjacent to a reproducible range and within a predetermined maximum relievable range is determined for at least one selected device primary color among the device primary colors as a function of the intensities of the display signals respectively correspond to the remaining device primary colors other than the selected device primary color. When the intensity of the display signal corresponding to the selected device primary color is within a first conversion range preset in a definition range, the intensity of the display signal is converted into the mixing quantity of the selected device primary color within the reproducible range. When the intensity of the display signal corresponding to the selected device primary color is within a second conversion range other than the first conversion range in the definition range, the intensity of the display signal is converted into the mixing quantity of the selected device primary color within the relievable range.

The second method of color conversion enables display signals to be input into a color display device into colorimetric values.

In accordance with one preferable application of the second method, the second conversion relation represents conversion from mixing quantities of virtual device primary colors of a virtual color display device to the colorimetric values, the virtual color display device having virtual single-color elements reproducing virtual single-color components associated with the single-color components reproduced by the single-color elements of the target color display device, respectively, wherein at least one selected virtual single-color component is determined so that the selected virtual single-color component has an identical hue with that of the associated single-color component and a higher saturation than that of the associated single-color component.

The present invention is further directed to a second color conversion apparatus which carries out color conversion. The second color conversion apparatus includes: a first color conversion device which converts colorimetric values representing a composite color into display signals that are to be input into a target color display device to reproduce the composite color, the display signals being related to mixing quantities of device primary colors in additive color mixture, the device primary colors being single-color components reproduced by respective single-color elements of the target color display device, the composite color being reproduced by the target color display device as a mixture of the device primary colors mixed by respective mixing quantities responsive to the display signals, wherein those display signals whose intensities are within a definition range are to be converted in the target color display device to the mixture quantities within a reproducible range, the definition range being divided into a first conversion range and a second conversion range; and a second color conversion device which comprises a color conversion look-up table including representative points for color conversion and converts the intensities of the display signals obtained by said first color conversion device into values of a predetermined color system using the representative points included in said color conversion look-up table and interpolation with the representative points.

The first color conversion device includes: a first conversion unit which converts the colorimetric values of the composite color into the mixing quantities of the device primary colors according to a first conversion relation; and a second conversion unit which converts the mixing quantities of the device primary colors into the intensities of the display signals according to a second conversion relation, respectively.

The second conversion unit determines a relievable range for at least one selected device primary color among the device primary colors as a function of the mixing quantities of the remaining device primary colors other than the selected device primary color, the relievable range being out of and adjacent to the reproducible range and within a predetermined maximum relievable range. When the mixing quantity of the selected device primary color is within the reproducible range, the second conversion unit converting the mixing quantity of the selected device primary color into the intensity of the display signal within the first conversion range. When the mixing quantity of the selected device primary color is within the relievable range, the second conversion unit converting the mixing quantity of the selected device primary color into the intensity of the display signal within the second conversion range.

An address of the color conversion look-up table used in the second color conversion device is given by combinations of the intensities of the display signals respectively corresponding to the device primary colors, the combinations of the intensities of the display signals comprising at least specific combinations including a specific boundary value as the intensity of the display signal corresponding to the selected device primary color, the specific boundary value being on a boundary between the first conversion range and the second conversion range.

This technique effectively prevents a specific area over the first conversion range and the second conversion range from being interpolated with an identical coefficient, thereby giving appropriate values in the color specification system.

In accordance with one preferable application of the second color conversion apparatus, the first conversion relation used by the first conversion unit represents conversion from the colorimetric values to mixing quantities of virtual device primary colors of a virtual color display device, the virtual color display device having virtual single-color elements reproducing virtual single-color components associated with the single-color components reproduced by the single-color elements of the target color display device, respectively, wherein at least one selected virtual single-color component is determined so that the selected virtual single-color component has an identical hue with that of the associated single-color component and a higher saturation than that of the associated single-color component.

These and other objects, features, aspects, and advantages of the present invention will become more apparent from the following detailed description of the preferred embodiments with the accompanying drawings.

BRIEF DESCRIPTION OF THE DRAWINGS

FIGS. 9(*a*) and 9(*b*) are tables showing chromaticity coordinates of the colors expressed by the respective ITU-R 709 fluorescent materials of red, green, and blue and chromaticity coordinates of the white D50;

FIG. 10 is a table showing the values x, y, and Y of the colors expressed by the fluorescent materials of red, green, and blue in the actual color monitor and white and the corresponding values L*, a*, and b* in the uniform color space coordinate system;

FIG. 11 is a table showing the values x, y, and Y of the colors expressed by the fluorescent materials of red, green, and blue in the virtual color monitor and white and the corresponding values L*, a*, and b* in the uniform color space coordinate system;

FIG. 22 shows available combinations of R, G, and B existing as addresses in the color conversion look-up table 170 shown in FIG. 21 and the corresponding values C, M, Y, and K stored at the addresses.

DESCRIPTION OF THE PREFERRED EMBODIMENTS

Figure 1:
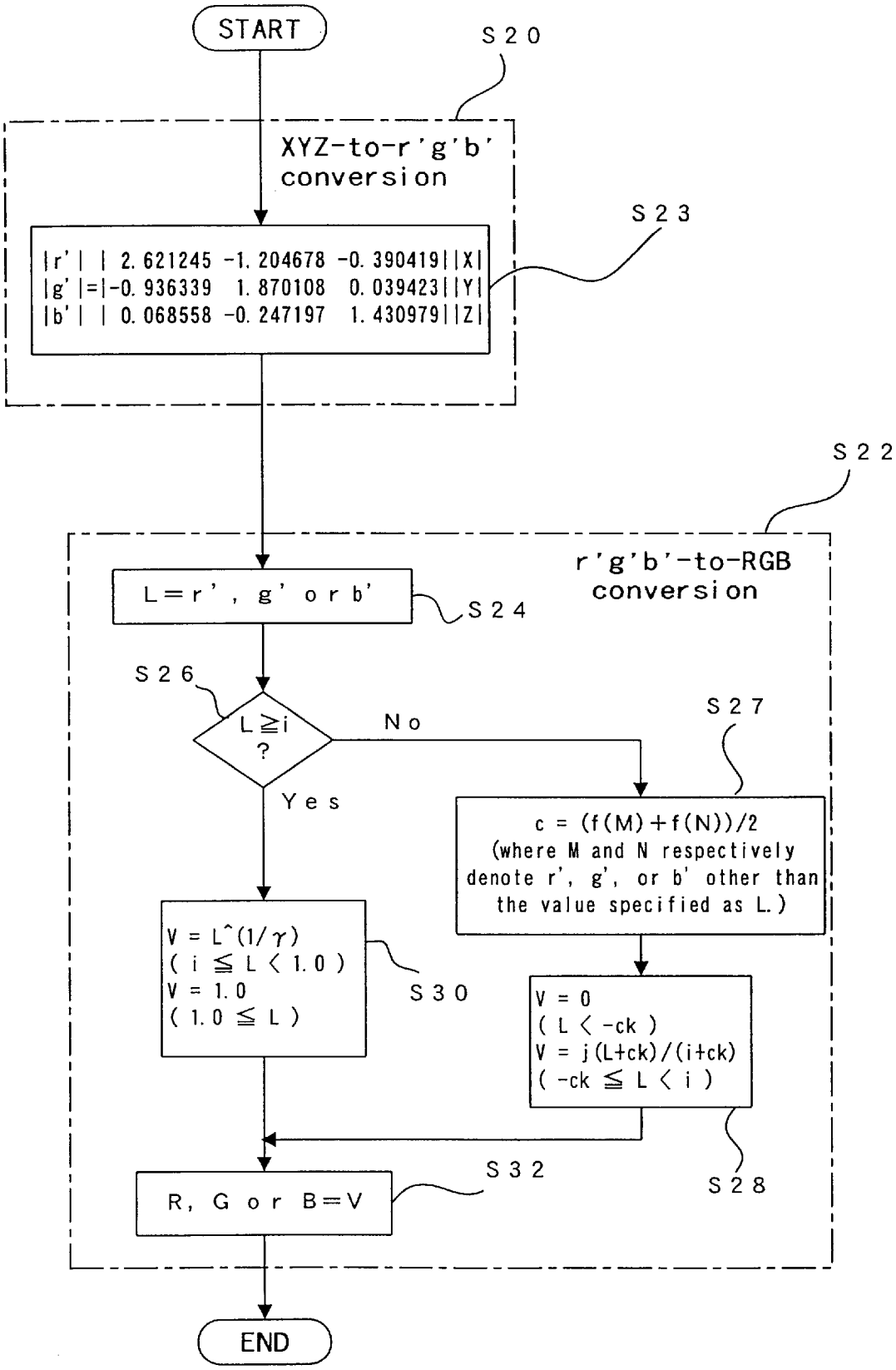
FIG. 1 is a flowchart showing a color conversion routine as a first embodiment according to the present invention.

Some modes of carrying out the present invention are discussed below as preferred embodiments. FIG. 1 is a flowchart showing a color conversion routine as a first embodiment according to the present invention.

By way of example, it is assumed that RGB color signals scanned for color printing are converted into RGB color signals for a color monitor and given to the color monitor for a display of a color image, in order to preview a final printing result in an intermediate stage of image processing for printing (for example, in the course of process).

When RGB color signals of a transparent film read by a scanner are converted into RGB color signals for a color monitor (RGB display signals), color conversion is generally carried out in the sequence of RGB to XYZ to RGB. XYZ here implies that the color conversion is carried out via a colorimetric system or a color specification system that does not depend upon a device, for example, L*a*b*, L*u*v*, or a combination thereof The color conversion method of the present invention is applied to color conversion of colorimetric values XYZ to display signals RGB (that is, the XYZ-to-RGB conversion).

The following describes the conventional color conversion method prior to the description regarding the flowchart of FIG. 1, for the purpose of the comparison between the color conversion method of the embodiment and the conventional color conversion method.

The conventional color conversion method converts colorimetric values XYZ to luminance-linear values r'g'b' (that is, the values proportional to the luminance) with respect to red, green, and blue, based on a relationship of color conversion obtained for a color monitor and expressed by Equation (1) given below:

$$\begin{pmatrix} r' \\ g' \\ b' \end{pmatrix} = \begin{pmatrix} 2.757777 & -1.308176 & -0.424273 \\ -0.993072 & 1.922088 & 0.042577 \\ 0.077090 & -0.282662 & 1.464701 \end{pmatrix} \begin{pmatrix} X \\ Y \\ Z \end{pmatrix} \quad (1)$$

The color monitor uses ITU-R 709 (former CCIR 709) fluorescent materials described later as the fluorescent materials of red, green, and blue and displays white of D50 (color temperature of 5000 degrees) under the condition of the maximum luminances of red, green, and blue (that is, when the respective fluorescent materials of red, green, and blue emit at the maximum luminances).

The values r'g'b' are luminance-linear or luminance-proportional values obtained by normalizing the luminances of red, green, and blue in the color monitor (that is, the luminances at which the respective fluorescent materials of red, green, and blue emit) to make the minimum luminance substantially equal to 0 and the maximum luminance substantially equal to 1. In a general color monitor, the respective fluorescent materials of red, green, and blue emit at appropriate luminances, and mixing the respective color rays of light expresses a desired color. The values r'g'b' accordingly represent mixing quantities of red, green, and blue when the primary colors, red, green, and blue, are mixed to express a desired color on the color monitor.

The values r'g'b' are normalized to have the minimum luminance substantially equal to 0 and the maximum luminance substantially equal to 1. When the color existing in a color range reproducible by the respective fluorescent materials of red, green, and blue in the color monitor (that is, in the gamut intrinsic to the color monitor) is subjected to the XYZ-to-r'g'b' conversion, the values r', g', and b' obtained by the conversion are within the range of 0 to 1. When the color out of the reproducible color range is subjected to the XYZ-to-r'g'b' conversion, on the other hand, at least one of the values r', g', and b' obtained by the conversion is out of the range of 0 to 1.

The conventional color conversion method subsequently converts the r'g'b' values to display signals RGB according to conversion functions expressed by Equations (2) given below, based on the y characteristics of the color monitor. The display signals R, G, and B are obtained by normalizing the intensities (that is, the voltages applied) of the display signals of red, green, and blue, which are to be input to the color monitor, to have the minimum value of 0 and the maximum value of 1.

$$\begin{aligned} V &= 0 && (L \le 0.0) \\ V &= L^{1/\gamma} && (0.0 \le L < 1.0) \\ V &= 1.0 && (1.0 \le L) \end{aligned} \quad (2)$$

where L denotes the luminances at which the fluorescent materials of red, green, and blue emit and corresponds to the values r', g', and b', and V denotes the intensities (that is, the voltages applied) of the display signals of red, green, and blue to be input to the color monitor and correspond to the values R, G, and B. The conversion functions of Equations (2) include the $1/\gamma$-th power of L in the range of $0 \leqq L < 1$.

The r'g'b'-to-RGB conversion converts the values r', g', and b' respectively into the values R, G, and B with respect to red, green, and blue.

In the conventional method, when the former XYZ-to-r'g'b' conversion gives a value of smaller than 0 (that is, L<0)

as one of the values r', g', and b', the latter r'g'b'-to-RGB conversion converts the value of smaller than 0 into the value R, G, or B=0 (that is, V=0) as clearly understood from Equations (2).

As described previously, when the former XYZ-to-r'g'b' conversion converts the color that exists out of the color range reproducible by the fluorescent materials of red, green, and blue in the color monitor and one of the values r', g', and b' obtained by the conversion is less than 0 (that is, out of the range of 0 to 1), the latter r'g'b'-to-RGB conversion converts the value of less than 0 into the value R, G, or B=0. This means that the r'g'b'-to-RGB conversion loses information regarding a desired color that is out of the reproducible color range, which causes a significant problem, such as abnormal tone or a change in hue, in an area of the desired color.

Figure 2:
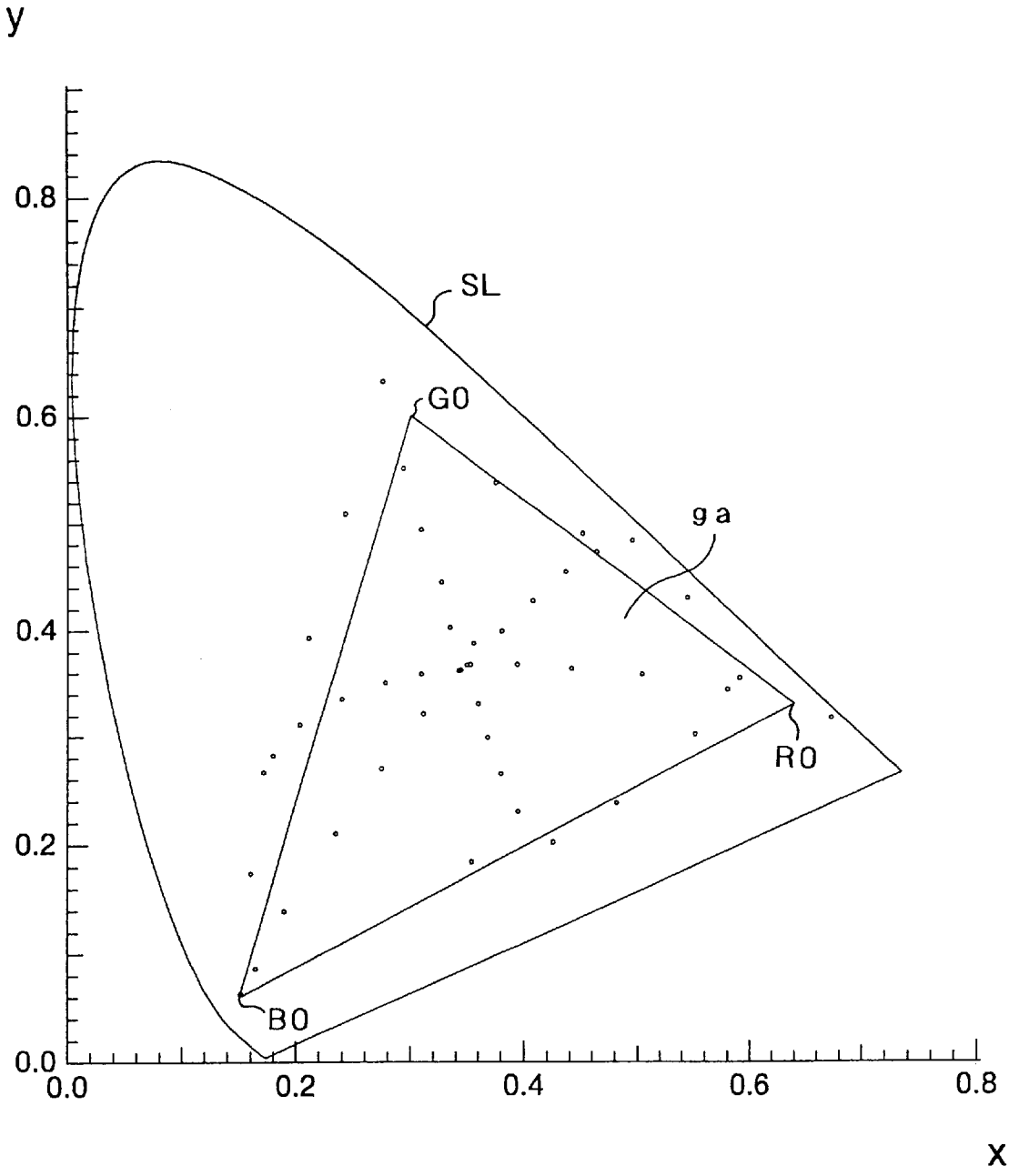
FIG. 2 is an x-y chromaticity diagram representing chromaticity coordinates of colors expressed by fluorescent materials of red, green, and blue used in an actual color monitor and chromaticity coordinates of respective colors obtained by colorimetry of a group of color patches in an actual positive film.

FIG. 2 is an x-y chromaticity diagram representing chromaticity coordinates of colors expressed by fluorescent materials of red, green, and blue used in an actual color monitor and chromaticity coordinates of respective colors obtained by colorimetry of a group of color patches in an actual positive film.

In the chromaticity diagram of FIG. 2, three vertexes R0, G0, and B0 of a triangle respectively represent chromaticity coordinates (that is, chromaticity points) of colors expressed by the fluorescent materials of red, green, and blue. Since the ITU-R 709 fluorescent materials are used as the fluorescent materials of red, green, and blue in the actual color monitor as discussed previously, the vertexes R0, G0, and B0 respectively denote the chromaticity coordinates of the colors expressed by the ITU-R 709 fluorescent materials. In the diagram of FIG. 2, open circles represent chromaticity coordinates of the respective colors obtained by colorimetry of a group of color patches. The color patch group used here is an IT8.7/1 color patch group and includes representative points shown in the diagram of FIG. 2.

The triangle defined by the vertexes R0, G0, and B0 represents a color range ga reproducible by the fluorescent materials of red, green, and blue (that is, the gamut intrinsic to the color monitor). SL denotes a locus of monochromatic light (spectrum locus).

The colors of the respective color patches are to be displayed on the color monitor as shown in FIG. 2. Part of these colors exist out of the triangular color range ga expressible by the fluorescent materials of red, green, and blue. The conventional color conversion method is here applied to convert the colorimetric values XYZ to the display signals RGB with respect to the colors of the respective color patches and give the converted display signals RGB to the color monitor. In this case, the respective colors are reproduced on the color monitor as shown in FIG. 3.

Figure 3:
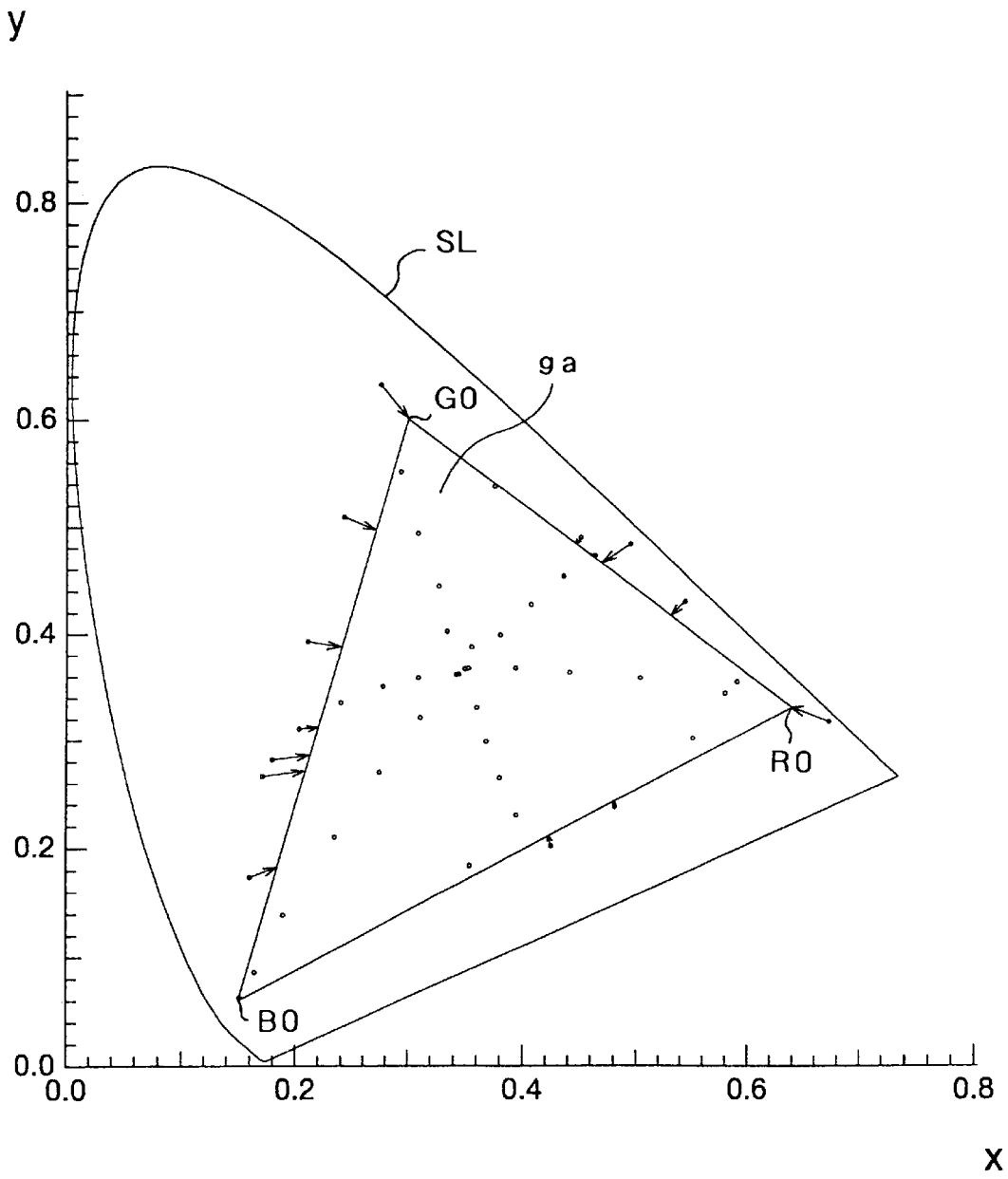
FIG. 3 is an x-y chromaticity diagram showing the colors of the respective color patches of FIG. 2 reproduced on the color monitor according to a conventional color conversion method.

FIG. 3 is an x-y chromaticity diagram showing the colors of the respective color patches of FIG. 2 reproduced on the color monitor according to the conventional color conversion method. Each vector in FIG. 3 shows the mapping of the original color of each color patch to the reproduced color on the color monitor. The open circle at the starting point of the vector represents the chromaticity coordinates of the original color of the color patch. The end point of the vector represents the chromaticity coordinates of the reproduced color on the color monitor. The length of the vector denotes the difference between the original color and the reproduced color (that is, the error).

As clearly shown in FIG. 3, the colors existing in the color range ga among the colors of the respective color patches are reproduced faithfully on the color monitor. The colors existing out of the color range ga are, on the other hand, shifted to the outer border of the color range ga and displayed on the color monitor in the distorted color state.

In case that the colorimetric values XYZ are converted into the display signals RGB according to the conventional color conversion method and given to the color monitor, the significant problems, such as abnormal tone or a change in hue, arise with respect to the colors that exist out of the color range ga reproducible by the fluorescent materials of red, green, and blue as discussed previously.

Figure 4:
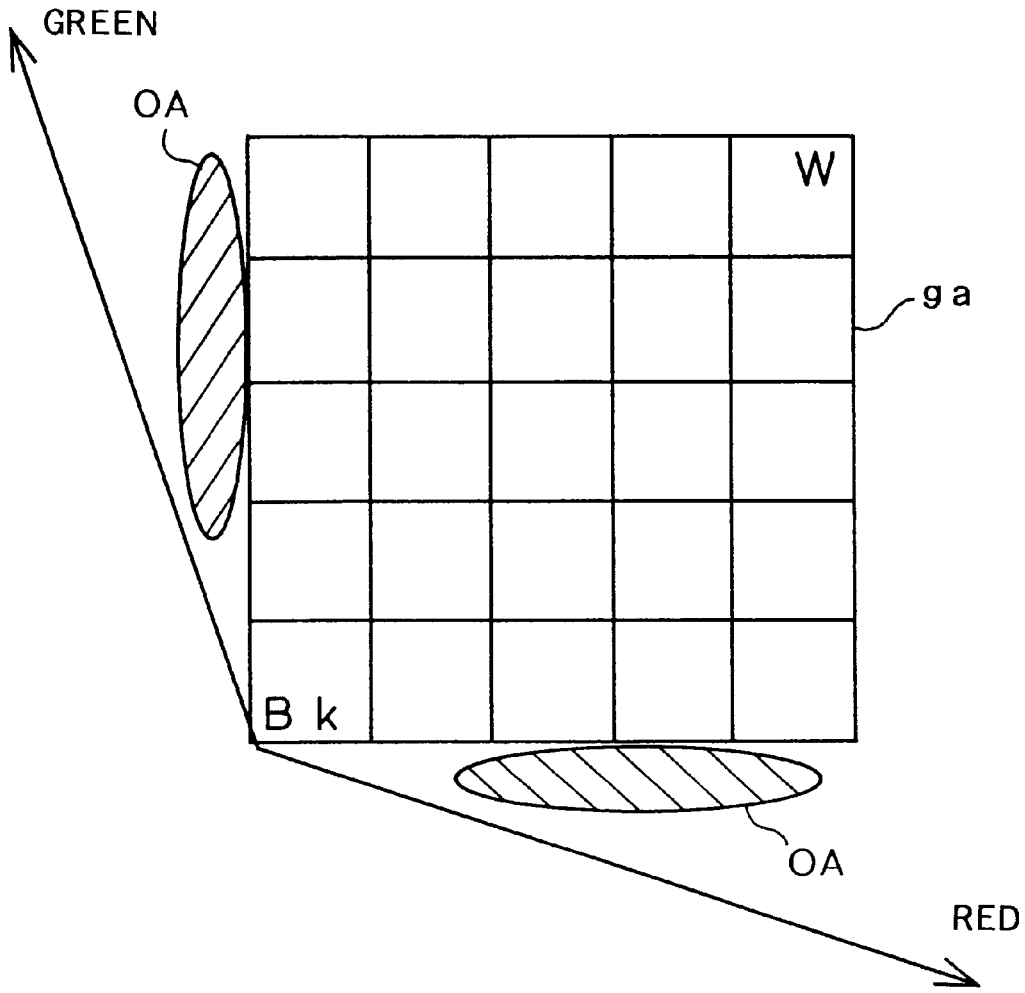
FIG. 4 shows a color range that is not relievable by the conventional color conversion method.

FIG. 4 shows a color range that is not relievable by the conventional color conversion method. In other words, FIG. 4 shows a three-dimensional color space projected on the red-green plane. In the diagram of FIG. 4, the area put between the axis of red direction and the axis of green direction (that is, two arrows) represents the area in which colors actually exist. The latticed rectangle denotes the color range or the gamut ga reproducible by the fluorescent materials of red, green, and blue in the actual color monitor on the red-green plane.

As described previously, the r'g'b'-to-RGB conversion loses information regarding a specific area of the colors that actually exist but are located out of the color range ga, for example, the colors in areas OA filled with slant lines in FIG. 4. Namely the colors within the areas OA can not be relieved by the conventional color conversion method.

The color conversion method of this embodiment has the following differences from the conventional color conversion method described above. The color monitor of this embodiment also uses ITU-R 709 (former CCIR 709) fluorescent materials as the fluorescent materials of red, green, and blue.

Referring to the flowchart of FIG. 1, the color conversion method of this embodiment first carries out color conversion of the colorimetric values XYZ into the values r'g'b', not based on the relationship of color conversion obtained for the actual color monitor but based on a relationship of color conversion obtained for a virtual color monitor, at step S20.

Figure 5:
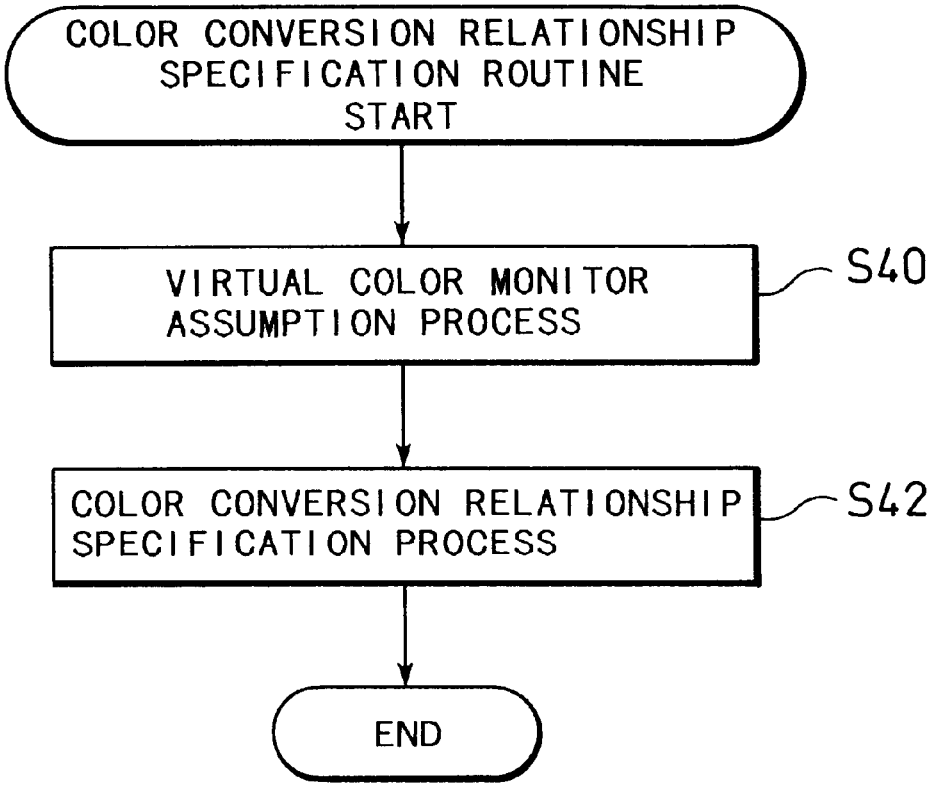
FIG. 5 is a flowchart showing a routine for specifying a relationship of color conversion used in the process of the XYZ-to-r'g'b' conversion of FIG. 1.

The relationship of color conversion for the virtual color monitor is obtained according to a color conversion relationship specification process shown in FIG. 5.

FIG. 5 is a flowchart showing a routine of specifying a relationship of color conversion used for the XYZ-to-r'g'b' conversion of FIG. 1.

When the program enters the color conversion relationship specification routine shown in FIG. 5, a virtual color monitor assumption process is carried out first at step S40 to assume a virtual color monitor against the actual color monitor. In the virtual color monitor assumed here, the actual chromaticity coordinates of the colors expressed by the fluorescent materials of red, green, and blue are replaced by virtual chromaticity coordinates having the same hues as those of the actual chromaticity coordinates but higher saturations than those of the actual chromaticity coordinates.

Figure 6:
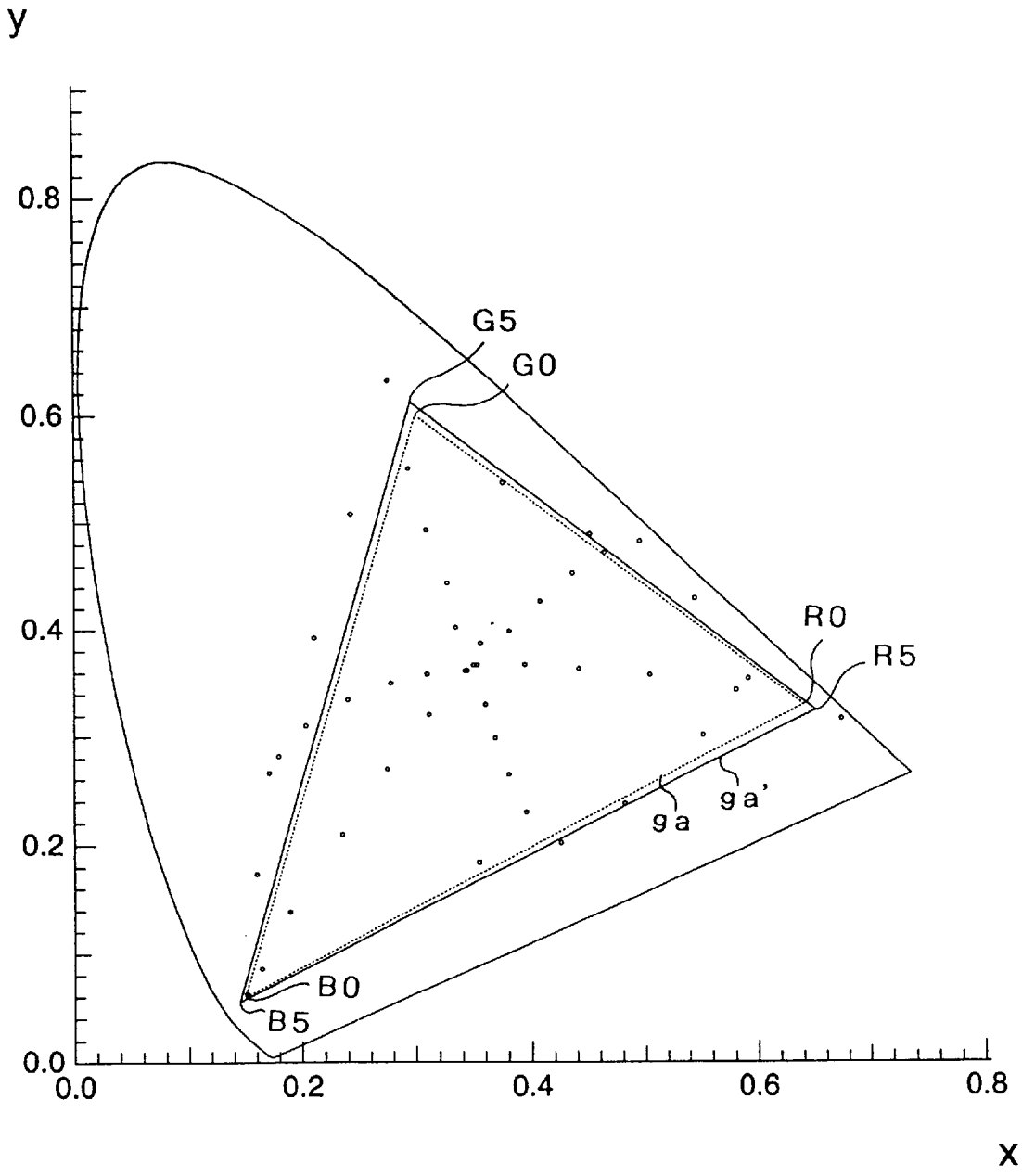
FIG. 6 is an x-y chromaticity diagram representing both actual chromaticity coordinates and virtual chromaticity coordinates with respect to the colors expressed by the fluorescent materials of red, green, and blue.

FIG. 6 is an x-y chromaticity diagram representing both the actual chromaticity coordinates and the virtual chromaticity coordinates with respect to the colors expressed by the fluorescent materials of red, green, and blue.

In the diagram of FIG. 6, vertexes R0, G0, and B0 of a dotted triangle represent chromaticity coordinates of the colors expressed by the fluorescent materials of red, green, and blue (ITU-R 709 fluorescent materials) in the actual color monitor (that is, the actual chromaticity coordinates), like in the diagram of FIG. 2.

Vertexes R5, G5, and B5 of a solid triangle, on the other hand, represent virtual chromaticity coordinates having the same hues as those of the actual chromaticity coordinates R0, G0, and B0 but 5% higher saturations than those of the actual chromaticity coordinates R0, G0, and B0.

Figure 7:
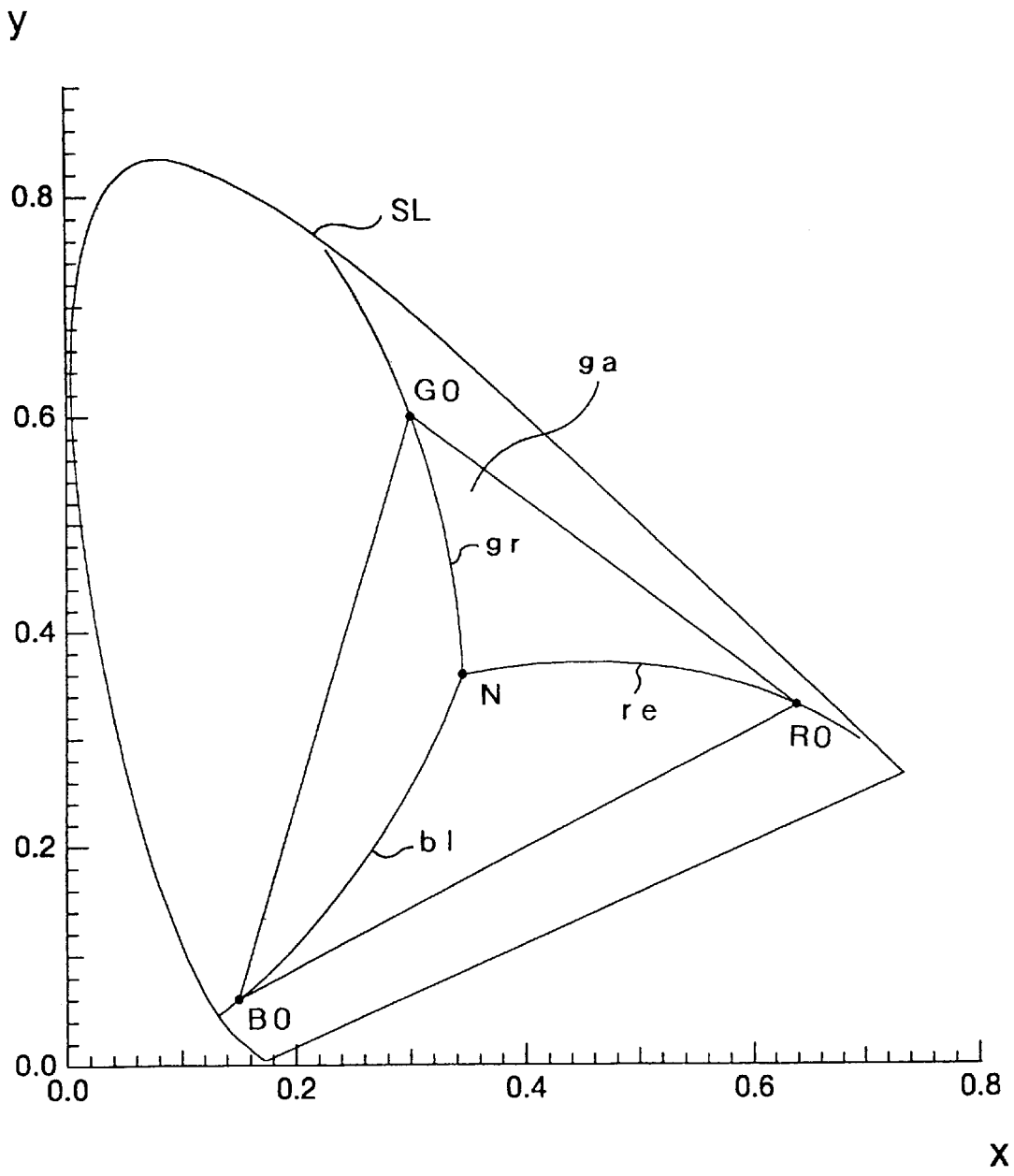
FIG. 7 is an x-y chromaticity diagram showing loci of chromaticity coordinates having the same hues as those of the actual chromaticity coordinates with respect to the colors expressed by the fluorescent materials of red, green, and blue.

FIG. 7 is an x-y chromaticity diagram showing loci of chromaticity coordinates having the same hues as those of the actual chromaticity coordinates with respect to the colors expressed by the fluorescent materials of red, green, and blue. In the diagram of FIG. 7, re, gr, and bl respectively denote loci of the chromaticity coordinates having the same hues as those of the actual chromaticity coordinates R0, G0, and B0 in the L*a*b* space. These loci start from an achromatic color point N and radially extend toward the periphery (that is, toward the higher saturations) to form curves.

Among the virtual chromaticity coordinates shown in FIG. 6, for example, the point of the virtual chromaticity coordinates R5 has the same hue as that of the actual chromaticity coordinates R0 of the color expressed by the fluorescent material of red and is located on the locus re shown in FIG. 7. The distance between the achromatic color point N and the virtual chromaticity coordinates R5 along the locus re is 5% longer toward the periphery (toward the higher saturation) in the L*a*b* space, compared with the distance between the achromatic color point N and the actual chromaticity coordinates R0. In a similar manner, the points of the virtual chromaticity coordinates G5 and B5 have the same hues as those of the actual chromaticity coordinates G0 and B0 of the colors expressed by the fluorescent materials of green and blue and are respectively located on the loci gr and bl shown in FIG. 7. The distances between the achromatic color point N and the respective virtual chromaticity coordinates G5 and B5 along the loci gr and bl are 5% longer toward the periphery (toward the higher saturations) in the L*a*b* space, compared with the distances between the achromatic color point N and the respective actual chromaticity coordinates G0 and B0.

In the virtual color monitor, the chromaticity coordinates of the colors expressed by the respective fluorescent materials of red, green, and blue are replaced by the virtual chromaticity coordinates shown in FIG. 6. Compared with the actual color monitor, the triangle color range reproducible by the fluorescent materials of red, green, and blue is enlarged in the virtual color monitor. This accordingly increases the number of the color patches (expressed by the open circles) included in a color range ga' that is shown by a solid triangle and reproducible by the fluorescent materials of red, green, and blue in the virtual color monitor.

In FIG. 6, the virtual chromaticity coordinates are plotted on the x-y chromaticity diagram. The virtual chromaticity coordinates may also be plotted on an a*-b* chromaticity diagram in a uniform color space (L*a*b* color space) coordinate system as shown in FIG. 8.

Figure 8:
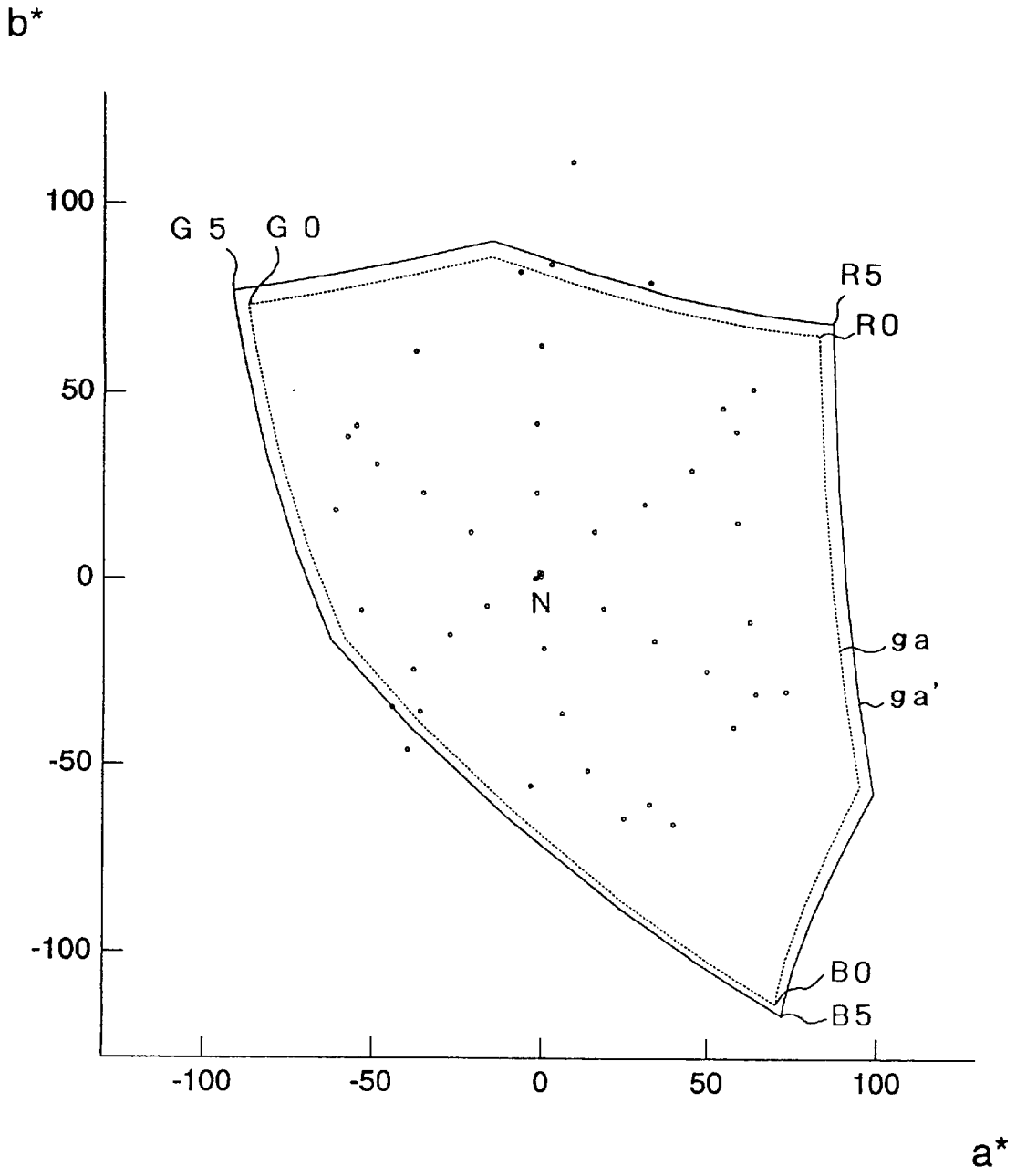
FIG. 8 is an a*-b* chromaticity diagram representing both actual chromaticity coordinates and virtual chromaticity coordinates with respect to the colors expressed by the fluorescent materials of red, green, and blue.

FIG. 8 is an a*-b* chromaticity diagram representing both the actual chromaticity coordinates and the virtual chromaticity coordinates with respect to the colors expressed by the fluorescent materials of red, green, and blue. In the diagram of FIG. 8, vertexes R0, G0, and B0 among the vertexes of a dotted polygon represent chromaticity coordinates of the colors expressed by the fluorescent materials of red, green, and blue (ITU-R 709 fluorescent materials) in the actual color monitor (that is, the actual chromaticity coordinates), like in the diagram of FIG. 6. The dotted polygon accordingly represents the color range ga reproducible by the fluorescent materials of red, green, and blue in the actual color monitor.

In the chromaticity diagram of the uniform color space coordinate system as shown in FIG. 8, the loci of the chromaticity coordinates having identical hues do not form curves as shown in FIG. 7 but form straight lines radially extending from the achromatic color point N toward the periphery (toward the higher saturations).

When the virtual chromaticity coordinates are plotted on the a*-b* chromaticity diagram in the uniform color space coordinate system as shown in FIG. 8, the virtual chromaticity coordinates are located on the straight lines that radially extend from the achromatic color point N toward the periphery. This system thus enables the virtual chromaticity coordinates to be specified readily.

In the diagram of FIG. 8, vertexes R5, G5, and B5 among the vertexes of a solid polygon represent virtual chromaticity coordinates having the same hues as those of the actual chromaticity coordinates R0, G0, and B0 but 5% higher saturations than those of the actual chromaticity coordinates R0, G0, and B0.

In the diagram of FIG. 8, the point of the virtual chromaticity coordinates R5 is located on the straight line extending radially from the achromatic color point N toward the periphery via the actual chromaticity coordinates R0 (that is, on the locus of the chromaticity coordinates having an identical hue). The distance between the achromatic color point N and the virtual chromaticity coordinates R5 is 5% longer toward the periphery (toward the higher saturation), compared with the distance between the achromatic color point N and the actual chromaticity coordinates R0. In a similar manner, the points of the virtual chromaticity coordinates G5 and B5 are respectively located on the straight lines extending radially from the achromatic color point N toward the periphery via the actual chromaticity coordinates G0 and B0. The distances between the achromatic color point N and the respective virtual chromaticity coordinates G5 and B5 are 5% longer toward the periphery, compared with the distances between the achromatic color point N and the respective actual chromaticity coordinates G0 and B0.

The solid polygon accordingly represents a color range ga' reproducible by the fluorescent materials of red, green, and blue in the virtual color monitor.

Referring back to the flowchart of FIG. 5, the program subsequently specifies a relationship of color conversion at step S42. In accordance with a concrete procedure, the program specifies a relationship of color conversion for the virtual color monitor assumed at step S40 to convert the colorimetric values XYZ into the values r', g', and b' representing the mixing quantities of red, green, and blue. When certain colorimetric values are converted into the mixing quantities of red, green, and blue and a resulting color is displayed on the virtual color monitor by mixing the mixing quantities of red, green, and blue, the relationship of color conversion of the colorimetric values XYZ into the mixing quantities r', g', and b' of red, green, and blue specified here enables the colorimetric values obtained by colorimetry of the displayed color to be equal to the original colorimetric values.

After specifying the relationship of color conversion of XYZ into r'g'b' for the virtual color monitor, the program exits from the color conversion relationship specification routine shown in FIG. 5.

The details of the color conversion relationship specification process are described according to equations.

FIGS. 9(*a*) and 9(*b*) are tables showing chromaticity coordinates of the colors expressed by the respective ITU-R 709 fluorescent materials of red, green, and blue and chromaticity coordinates of the white D50.

In this embodiment, the ITU-R 709 (former CCIR 709) fluorescent materials are used as the fluorescent materials of red, green, and blue in the actual color monitor as mentioned previously. ITU represents International Telecommunication Union. Its Recommendation(R) 709 (HDTV standard) defines the chromaticity coordinates of the colors expressed by the fluorescent materials of red, green, and blue (emission chromaticity coordinates) as shown in the table of FIG. 9(*a*).

Specification of the chromaticity coordinates of white in addition to the chromaticity coordinates of the colors expressed by the fluorescent materials of red, green, and blue determines a ratio of the maximum luminances of red, green, and blue in the actual color monitor.

When the white of D50 (color temperature of 5000 degrees) is used as white, for example, the chromaticity coordinates of white are given as shown in the table of FIG. 9(*b*). The ratio of the maximum luminances of red, green, and blue in the actual color monitor is expressed by Equation (3) given below:

$$Ew=0.24989Er+0.6980099Eg+0.0520963Eb \tag{3}$$

where Ew, Er, Eg, and Eb denote vectors having the Y component equal to one and the chromaticity coordinates of white, red, green, and blue.

The colorimetric values X, Y, and Z are rewritten as Equations (4) through (7) given below:

$$x=X/(X+Y+Z) \tag{4}$$

$$y=Y/(X+Y+Z) \tag{5}$$

$$z=Z/(X+Y+Z) \tag{6}$$

$$z=1-x-y \tag{7}$$

The relationship of color conversion of r', g', and b' into X, Y, and Z is accordingly expressed by Equation (8) given below:

$$\begin{pmatrix} X \\ Y \\ Z \end{pmatrix} = \begin{pmatrix} 0.484646 & 0.349004 & 0.130240 \\ 0.249896 & 0.698008 & 0.052096 \\ 0.022718 & 0.116335 & 0.685932 \end{pmatrix} \begin{pmatrix} r' \\ g' \\ b' \end{pmatrix} \tag{8}$$

Equation (8) represents the relationship of color conversion of r', g', and b' into X, Y, and Z in the actual color monitor.

An inverse matrix with respect to the matrix expressed by Equation (8) specifies the relationship of color conversion of X, Y, and Z into r', g', and b' as Equation (1) given above.

Equation (1) namely represents the relationship of color conversion of X, Y, and Z into r', g', and b' in the actual color monitor.

The chromaticity coordinates of the colors expressed by the fluorescent materials of red, green, and blue in the virtual color monitor, that is, the virtual chromaticity coordinates, are then specified, based on the chromaticity coordinates of the colors expressed by the fluorescent materials of red, green, and blue in the actual color monitor, that is, the actual chromaticity coordinates, and the chromaticity coordinates of white.

FIG. 10 is a table showing the values x, y, and Y of the colors expressed by the fluorescent materials of red, green, and blue in the actual color monitor and white and the corresponding values L*, a*, and b* in the uniform color space coordinate system. Here Y is normalized in the range of 0 to 100.

In case that the values x, y, and Y of the colors expressed by the fluorescent materials of red, green, and blue in the actual color monitor and white are specified as shown by the left three columns in the table of FIG. 10, the corresponding values L*, a*, and b* in the uniform color space coordinate system are determined as shown by the right three columns in the table of FIG. 10.

The color conversion method of this embodiment multiplies the values a* and b* shown in the table of FIG. 10 by a fixed coefficient greater than one while keeping the value L* shown in the table of FIG. 10 unchanged, in order to specify the virtual chromaticity coordinates in the virtual color monitor with respect to the colors expressed by the fluorescent materials of red, green, and blue based on the actual chromaticity coordinates in the actual color monitor.

This process specifies the virtual chromaticity coordinates at the positions having the longer distances from the achromatic color point N toward the periphery than the actual chromaticity coordinates along the straight lines extending radially from the achromatic color point N toward the periphery (toward the higher saturations) on the a*-b* chromaticity diagram in the uniform color space coordinate system shown in FIG. 8.

When the fixed coefficient is equal to 1.05, the virtual chromaticity coordinates R5, G5, and B5 are plotted at the positions having the 5% longer distances from the achromatic color point N toward the periphery than the actual chromaticity coordinates R0, G0, and B0 as shown in FIG. 8.

FIG. 11 is a table showing the values x, y, and Y of the colors expressed by the fluorescent materials of red, green, and blue in the virtual color monitor and white and the corresponding values L*, a*, and b* in the uniform color space coordinate system.

The values a* and b* shown in the table of FIG. 10 are multiplied by the coefficient 1.05, while the value L* shown in the table of FIG. 10 is kept unchanged. This gives the values L*, a*, and b* as shown by the right three columns in the table of FIG. 11. The left three columns in the table of FIG. 11 show the x, y, and Y values corresponding to these values L*, a*, and b*. The values x, y, and Y thus obtained are with respect to the colors expressed by the fluorescent materials of red, green, and blue in the virtual color monitor and white. The values x and y of red, green, and blue represent chromaticity coordinates of the colors expressed by the respective fluorescent materials of red, green, and blue in the virtual color monitor, namely the virtual chromaticity coordinates.

Using the values x, y, and Y of the colors expressed by the fluorescent materials of red, green, and blue in the virtual color monitor and white and Equations (4) through (7) given above, the relationship of color conversion of r, g', and b' into X, Y, and Z is expressed as Equation (9) given below:

$$\begin{pmatrix} X \\ Y \\ Z \end{pmatrix} = \begin{pmatrix} 0.498991 & 0.338202 & 0.126824 \\ 0.249434 & 0.701848 & 0.048718 \\ 0.019183 & 0.105039 & 0.701162 \end{pmatrix} \begin{pmatrix} r' \\ g' \\ b' \end{pmatrix} \tag{9}$$

Equation (9) represents the relationship of color conversion of r', g', and b' into X, Y, and Z in the virtual color monitor.

An inverse matrix with respect to the matrix expressed by Equation (9) specifies the relationship of color conversion of X, Y, and Z into r', g', and b' as Equation (10) given below:

$$\begin{pmatrix} r' \\ g' \\ b' \end{pmatrix} = \begin{pmatrix} 2.621245 & -1.204678 & -0.390419 \\ -0.936339 & 1.870108 & 0.039423 \\ 0.068558 & -0.247197 & 1.430979 \end{pmatrix} \begin{pmatrix} X \\ Y \\ Z \end{pmatrix} \tag{10}$$

Equation (10) namely represents the relationship of color conversion of X, Y, and Z into r', g', and b' in the virtual color monitor.

In this manner, the color conversion relationship specification process concretely specifies the relationship of color conversion of X, Y, and Z into r', g', and b'.

Referring back to the flowchart of FIG. 1, the concrete procedure of XYZ-to-r'g'b' conversion executed at step S20 carries out color conversion of X, Y, and Z into r', g', and b' according to the relationship of color conversion thus obtained for the virtual color monitor, that is, according to Equation (10), at step S23.

The color conversion of X, Y, and Z into r', g', and b' based on the relationship of color conversion obtained for the virtual color monitor enables the resulting values r', g', and b' to be within the range of 0 to 1, with respect to the specific colors that are out of the color range or the gamut ga reproducible by the fluorescent materials of red, green, and blue in the actual color monitor but are within the color range or the gamut ga' reproducible by the fluorescent materials of red, green, and blue in the virtual color monitor. This prevents the latter r'g'b'-to-RGB conversion from losing information regarding the desired color.

At subsequent step S22, the values r', g', and b' obtained at step S20 are converted into display signals R (red), G (green), and B (blue) to be input to the actual color monitor.

In accordance with a concrete procedure, one of the values r', g', and b' obtained at step S20 is set to L at step S24, and it is determined at step S26 whether or not the value L is not less than i, where i is the γ-th power of j and greater than 0.

In case that the value L is less than i at step S26, the program proceeds to step S27, at which a value c is calculated according to Equation (11) given below:

$$C = \frac{f(M) + f(N)}{2} \tag{11}$$

where M and N denote values other than L set at step S24 among the values r', g', and b' obtained at step S20. By way of example, when the value r' is set to L at step S24, M and N respectively denote the values g' and b'. In Equation (11), f is a function of either M or N as expressed by Equations (12) given below:

$$\begin{aligned} f(d) &= 0 \quad (d < 0.0) \\ f(d) &= d \quad (0.0 < d < 1.0) \\ f(d) &= 1 \quad (1.0 < d) \end{aligned} \tag{12}$$

where d represents either M or N.

Here it is assumed that the value r' is set to L. When both the values g' and b' are within the range of not less than 0 and not greater than 1, f(g')=g' and f(b')=b' according to Equations (12). In this case, the value c is the mean of g' and b', that is, (g'+b')/2 as clearly understood from Equation (11). When both the values g' and b' are less than 0, f(g')=0 and f(b')=0 according to Equations (12). When both the values g' and b' are greater than 1, f(g')=1 and f(b')=1 according to Equations (12). Namely the value c is always within the range of not less than 0 and not greater than 1.

After calculating the value c in the above manner at step S27, the program carries out conversion of L into V using the value c according to conversion functions expressed by Equations (13) given below at step S28:

$$\begin{aligned} V &= 0 \quad (L < -ck) \\ V &= \frac{j(L + ck)}{i + ck} \quad (-ck \le L < i, \text{ where } i = j^{\gamma} > 0) \end{aligned} \tag{13}$$

where i is the γ-th power of j and greater than 0, and j and k respectively denote preset values greater than 0.

In case that the value L is not less than i at step S26, on the other hand, the program proceeds to step S30, at which the program carries out conversion of L into V according to conversion functions expressed by Equations (14) given below:

$$\begin{aligned} V &= L^{1/\gamma} \quad (i \le L < 1.0) \\ V &= 1.0 \quad (1.0 \le L) \end{aligned} \tag{14}$$

Figure 12:
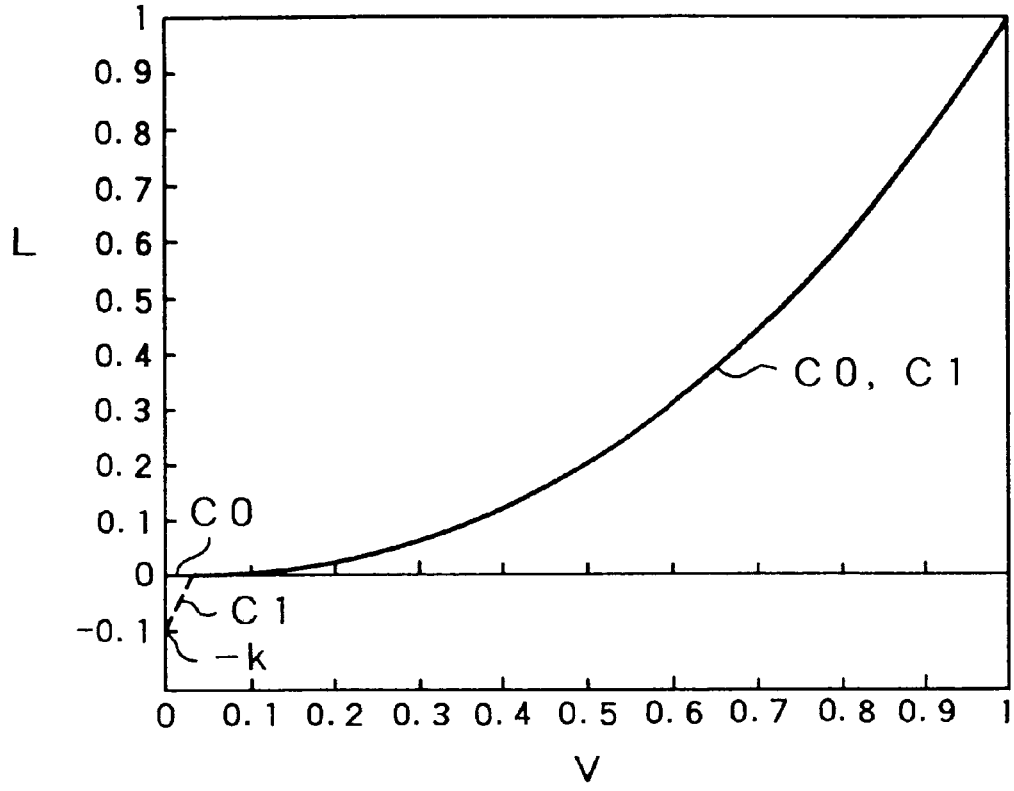
FIG. 12 is a graph showing the comparison between the conversion characteristics of L into V used in the process of r'g'b'-to-RGB conversion according to the conventional method and the same according to the method of the first embodiment.
Figure 13:
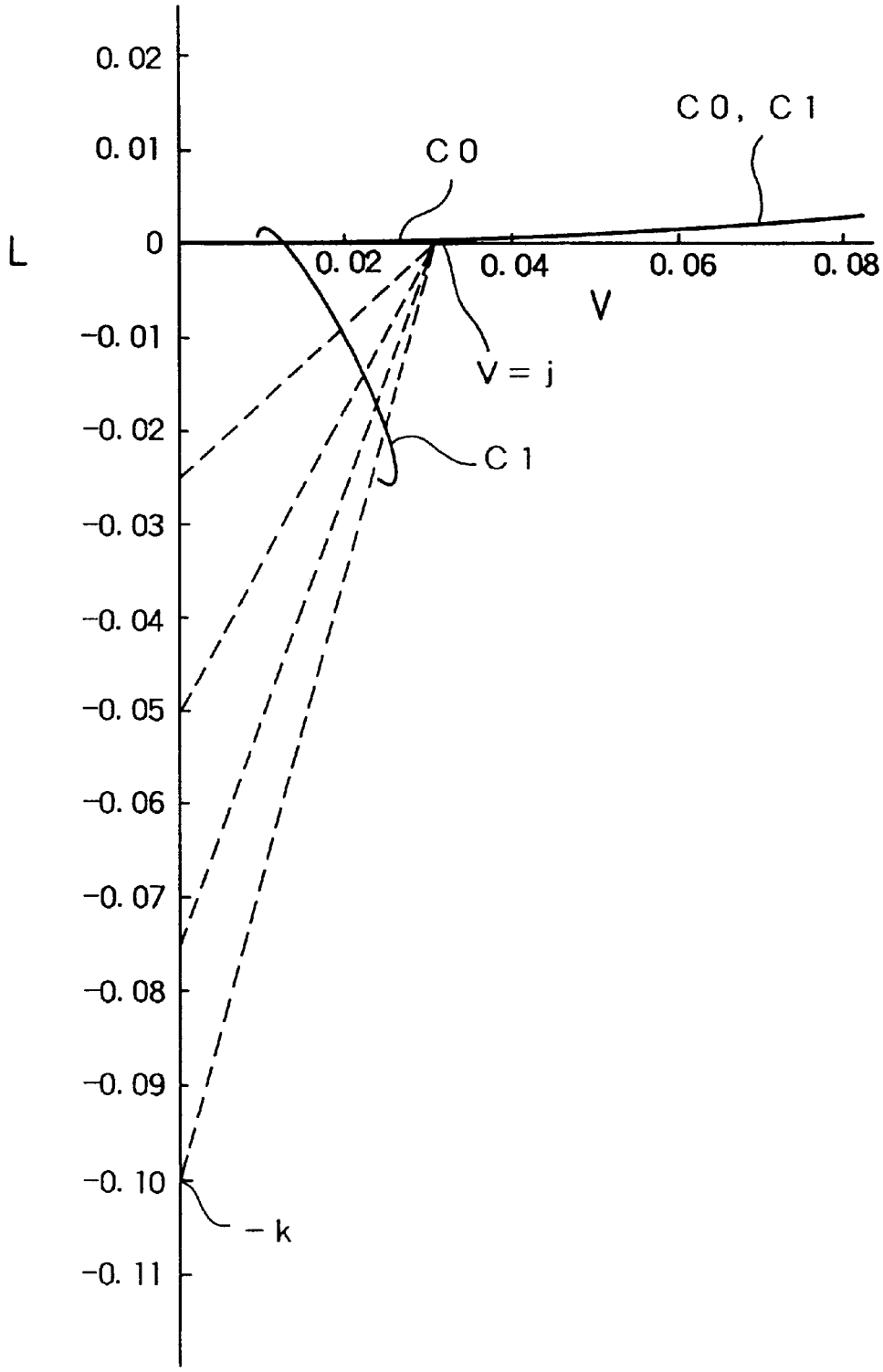
FIG. 13 is an enlarged view showing an essential part of the conversion characteristics of FIG. 12.

FIGS. 12 and 13 are graphs showing the comparison between the conversion characteristics of L into V used in the process of r'g'b'-to-RGB conversion according to the conventional method and the same according to the method of this embodiment. FIG. 13 is an enlarged view showing a part in the vicinity of (L,V)=(0,0.03) in the graph of FIG. 12.

In the graphs of FIGS. 12 and 13, a solid curve C0 represents the conversion characteristics of the conventional method and more specifically the conversion characteristics obtained by the conversion functions of Equations (2). A dashed curve C1 represents the conversion characteristics of the method of this embodiment and more specifically the conversion characteristics obtained by the conversion functions of Equations (13) and (14). In the graphs of FIGS. 12 and 13, the value y in Equations (2) and (14) is set equal to 3, the value k in Equations (13) equal to 0.1, and the value j in Equations (13) equal to 0.03.

As seen in the graph of FIG. 13, the dashed curve C1 representing the conversion characteristics of this embodiment includes a linear portion in the range of V of not less than 0 and less than j. The slope (dV/dL) of the linear portion is j/(i+ck) according to Equations (13) and the L intercept is equal to −ck. Both the slope and the L intercept of the linear portion accordingly vary with a variation in the value c calculated at step S27. Since the value c is always in the range of not less than 0 and not greater than 1 and the value k is greater than 0 as discussed previously, the value −ck of the L intercept is in the range of not less than −k and not greater than 0.

In the conventional method, as shown by the solid curve C0 of FIG. 12, all the values L of less than 0 (L<0) are converted into the value V=0. This means that the r'g'b'-to-RGB conversion loses information regarding the desired color that is out of the color range ga shown in FIG. 4.

In the method of this embodiment, on the other hand, as shown by the dashed curve C1 of FIGS. 12 and 13, the values L of not less than −ck and less than i (−ck≦L<i) are converted into the values L of not less than 0 and less than j by the linear function of L. The range of not less than −ck and less than 0 (−ck≦L<0) is included in the range of not less than −ck and less than i (−ck≦L<i). The information is accordingly not lost with respect to the desired color that is out of the color range ga but has the value L in the range of not less than −ck and less than 0 (−ck≦L<0). The value c is varied in the range of not less than 0 and not greater than 1 as mentioned above. The range of not less than −ck and less than 0 is narrowed when the value c is closer to 0, and is widened when the value c is closer to 1.

As discussed previously, the information is not lost with respect to the desired color that is out of the color range ga but within the color range ga' of the virtual color monitor, since the values r', g', and b' are all in the range of 0 to 1 ($0 \leqq L < 1$).

The values L of less than −ck ($L < -ck$) are converted into the value V=0 according to Equations (13), in the same manner as the conventional method.

The values L of not less than i and less than 1 ($i \leqq L < 1$) are converted into the values V of not less than j and less than 1. In this case, the values L are converted into the values V by the function representing the γ characteristics of the actual color monitor, that is, the 1/γ-th power of L included in Equations (14), which is identical with the 1/γ-th power of L included in Equations (2) of the conventional method. Namely the dashed curve C1 of this embodiment overlaps the solid curve C0 of the conventional method in this range.

The values L of not less than 1 ($1 \leqq L$) are converted into the value V=1 according to Equations (14), in the same manner as the conventional method.

After the conversion into the value V at either step S28 or step S30, the program proceeds to step S32 to set the value V to one of the display signals R, G, and B corresponding to the one of the values r', g', and b' selected at step S24.

The r'g'b'-to-RGB conversion of step S22 accordingly converts the values r', g', and b' of red, green, and blue respectively into the display signals R, G, and B.

Figure 14:
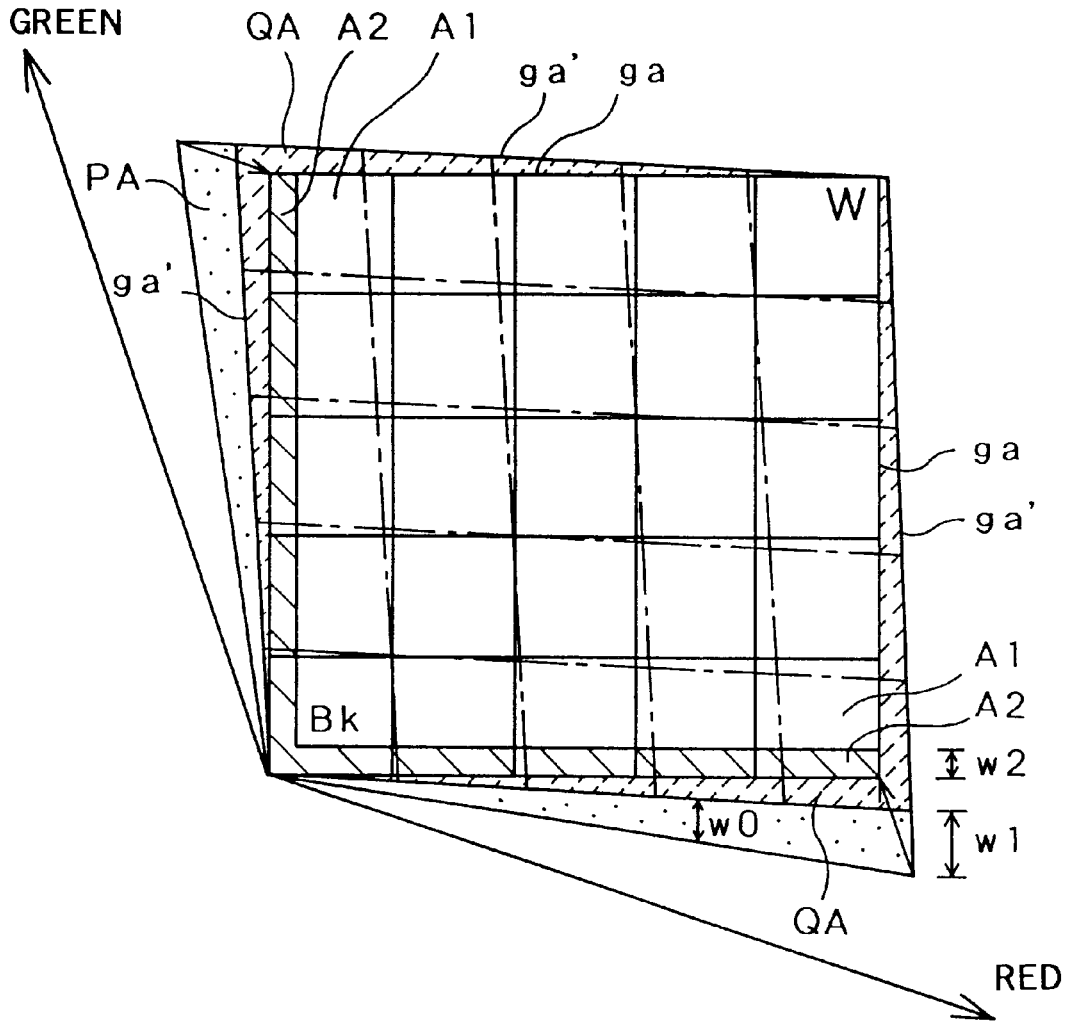
FIG. 14 shows a color range relievable by the color conversion method of the first embodiment and positional changes of the respective colors before and after the conversion.

FIG. 14 shows a color range relievable by the color conversion method of the embodiment and positional changes of the respective colors before and after the conversion. In other words, FIG. 14 shows a three-dimensional color space projected on the red-green plane, like the diagram of FIG. 4. In the diagram of FIG. 14, the area put between the axis of red direction and the axis of green direction (that is, two arrows) represents the area in which colors actually exist. A solid rectangle latticed by the solid lines denotes the color range or the gamut ga reproducible by the fluorescent materials of red, green, and blue in the actual color monitor. A solid parallelogram latticed by the one-dot chain lines denotes the color range or the gamut ga' reproducible by the fluorescent materials of red, green, and blue in the virtual color monitor.

In the color conversion method of this embodiment, the processing of step S23 in the XYZ-to-r'g'b' conversion process shown in the flowchart of FIG. 1 converts the colors within the color range ga' of the virtual color monitor (that is, within the solid parallelogram latticed by the one-dot chain lines) all into the colors within the color range ga of the actual color monitor (that is, within the solid rectangle latticed by the solid lines) as shown in FIG. 14. The processing of step S30 in the r'g'b'-to-RGB conversion process further converts the converted colors that are within a conversion area A1 expressed by a solid rectangle latticed by the solid lines in the color range ga (that is, an area other than a conversion area A2 filled with the solid slant lines in the color range ga) into the colors within the conversion area A1.

The above procedure thus converts the colors that are out of the color range ga of the actual color monitor but within the color range ga' of the virtual color monitor (that is, the colors within an area QA filled with dashed slant lines shown in FIG. 14) all into the colors within the color range ga. Namely the color conversion method of this embodiment relieves the colors within the area QA.

Figure 15:
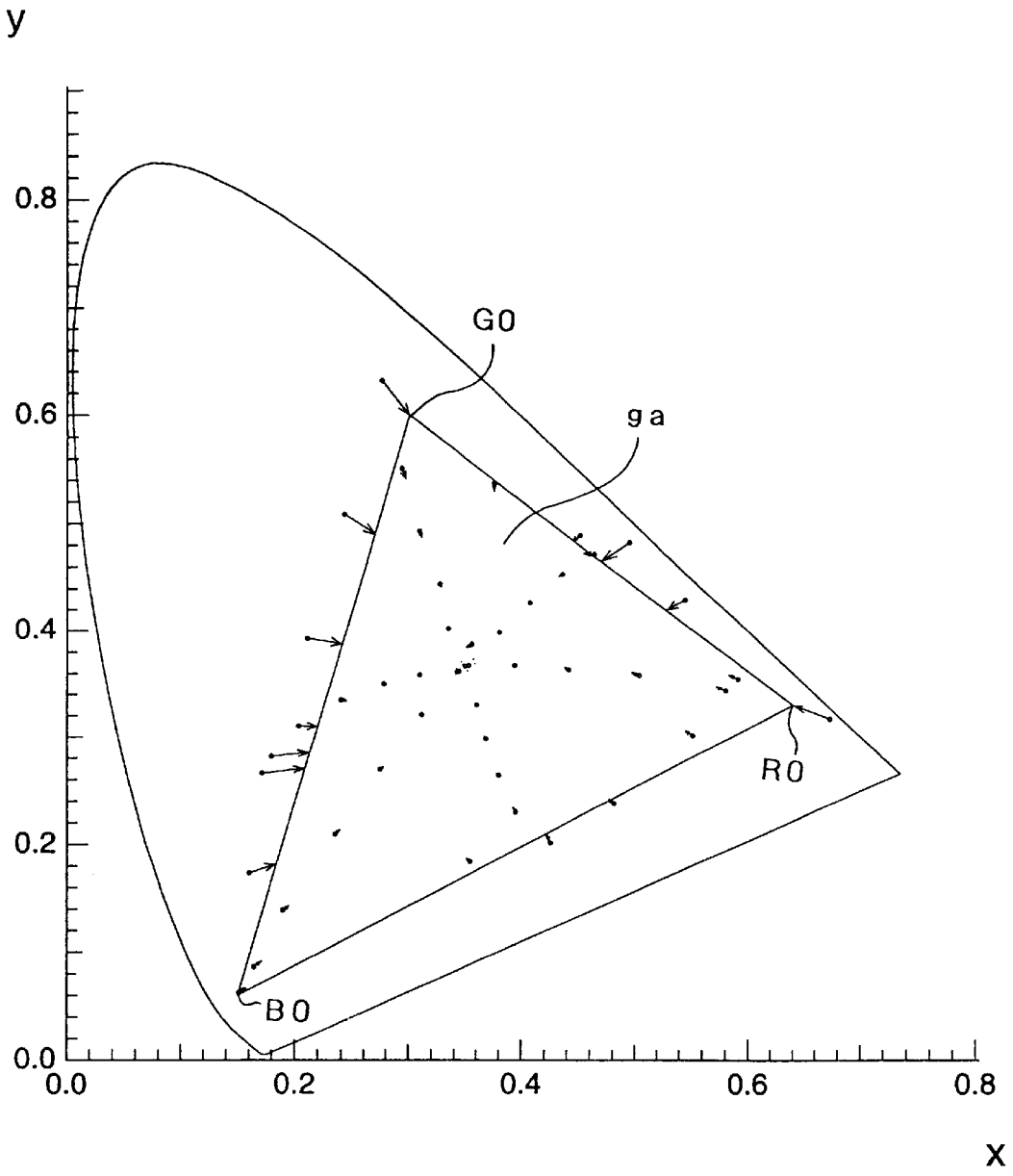
FIG. 15 is an x-y chromaticity diagram illustrating the respective color patches of FIG. 2 reproduced in the actual color monitor by the color conversion method of the first embodiment.

FIG. 15 is an x-y chromaticity diagram illustrating the respective color patches of FIG. 2 reproduced in the actual color monitor by the color conversion method of this embodiment. In the diagram of FIG. 15, the vectors have the same meanings as those shown in FIG. 3 and are thus not specifically described here.

The given colorimetric values XYZ are converted into the display signals RGB based on the relationship of color conversion specified for the virtual color monitor, and the resulting display signals RGB are given not to the virtual color monitor but to the actual color monitor. The colors expressed by the ITU-R 709 fluorescent materials of red, green, and blue in the actual color monitor have the chromaticity coordinates R0, G0, and B0. The respective colors are accordingly converted into the colors within the triangle defined by the vertexes R0, G0, and B0 (within the color range ga) as shown in FIG. 15.

In an area (not specified in FIG. 15) corresponding to the color range ga' of FIG. 6, all the vectors have the directions along the loci of the chromaticity coordinates having the identical hues as shown in FIG. 7, and there exist no vectors having different directions. This means that all the reproduced colors have the same hues as those of the original colors. The hue accordingly does not change whether or not the colors are within or out of the color range ga.

In the area corresponding to the color range ga', the vectors have the length gradually and continuously shortened when approaching the achromatic color point N. This means that the normal tone is maintained for all the colors. Abnormal tone is thus not observed for any colors having high saturation as well as those having low saturation.

The color conversion method of this embodiment accordingly maintains the normal tone and interferes with a change in hue, with respect to the area of colors having high saturation.

Referring back to the diagram of FIG. 14, the processing of step S23 in the XYZ-to-r'g'b' conversion process and the processing of step S28 in the r'g'b'-to-RGB conversion process shown in the flowchart of FIG. 1 convert the colors that are out of the color range ga of the actual color monitor and out of the color range ga' of the virtual color monitor but within a dotted area PA into the colors within the conversion area A2 filled with the solid slant lines in the color range ga of the actual color monitor. The dotted area PA accordingly represents the area relieved by the r'g'b'-to-RGB conversion of this embodiment. The colors in the dotted relievable area PA are converted into the colors in the conversion area A2. For example, the colors located on the outer-most circumference of the dotted area PA are converted into the colors located on the outer-most circumference of the conversion area A2 as shown by the arrows in FIG. 14.

The above processing converts the colors that are out of the color range ga of the actual color monitor but within the area PA into the colors within the conversion area A2. Namely the colors in the area PA as well as the colors in the area QA are relieved by the color conversion method of this embodiment.

The processing of step S28 converts the colors within the conversion area A2 among the colors within the color range ga converted by the processing of step S23 as well as the colors within the relievable area PA into the colors within the conversion area A2.

After the conversion by the processing of step S23, the relievable area PA corresponds to the values L of not less than −ck and less than 0 and has a width w0 equal to ck. Since the value c is varied according to Equations (11) and (13), the width w0 of the relievable area PA is varied in the following manner. Here it is assumed that the value r' is set to L. When f(g')=0 and f(b')=0, the value c is equal to 0, so that the width w0 takes the minimum value 0. When f(g')=1 and f(b')=1, the value c is equal to 1, so that the width w0 takes the maximum value k. When f(g')=g' and f(b')=b', the value c is equal to (g'+b')/2, so that the width w0 is equal to (g'+b')k/2. In this case, the width w0 is proportional to the values g' and b'. The width w0 of the relievable area PA with respect to the red direction is linearly widened with increases in values of green and blue (g',b'), where the blue direction is perpendicular to the sheet surface of FIG. 14.

The width w0 of the relievable area PA has a maximum width w1, which corresponds to the value L=k. A width w2 of the conversion area A2 corresponds to the value V=j. The width of one side of the color range ga corresponds to the value L=1 or V=1. Since the value k is set equal to 0.1 and the value j equal to 0.03 in this embodiment, the width w2 of the conversion area A2 is narrower than the maximum width w1 of the relievable area PA.

The colors located in a part of the relievable area PA having the width w0 greater than the width w2 of the conversion area A2 are converted in the contracted manner into the conversion area A2 of the narrower width by the processing of step S28. The colors located in the remaining part of the relievable area PA having the width w0 narrower than the width w2 of the conversion area A2 are, on the other hand, converted in the expanded manner into the conversion area A2 of the greater width. The former colors have the chromaticity points densely dispersed in the conversion area A2, whereas the latter colors have the chromaticity points sparsely dispersed in the conversion area A2.

The colors existing in the conversion area A1 among the colors in the color range ga converted by the processing of step S23 are converted into the colors within the conversion area Al by the r'g'b'-to-RGB conversion. There are thus substantially no positional shifts of colors (shifts of chromaticity points) before and after the conversion with respect to these colors.

In the diagram of FIG. 14, a wide-angle area other than the narrow-angle area defined by the axis of red direction and the axis of narrow direction (two arrows) represents the area in which colors do not actually exist. In this embodiment, the relievable area PA is not included at all in this wide-angle area. Colors thus actually exist in the conversion area A2, into which the colors in the relievable area PA are converted by the r'g'b'-to-RGB conversion.

As described above, the colorimetric values XYZ converted by the method of this embodiment include the colors that are out of the color range or the gamut ga reproducible by the fluorescent materials of red, green, and blue in the actual color monitor. The resulting values r', g', and b' obtained by the XYZ-to-r'g'b' conversion are all within the range of 0 to 1, with respect to the specific colors that are out of the color range ga of the actual color monitor but within the color range or the gamut ga' reproducible by the fluorescent materials of red, green, and blue in the virtual color monitor. The latter r'g'b'-to-RGB conversion accordingly does not lose information regarding the desired color. With respect to the colors out of the color range ga' of the virtual color monitor, even when one of the values r', g', and b' is less than zero (L<0), as long as the value is not less than −ck (L≧−ck), the resulting converted value R, G, or B is not less than 0 and less than j (0≦V<j). Information is not lost but is kept as the resulting values R, G, and B, with respect to the colors that are out of the color range ga' of the virtual color monitor but have the values r', g', and b' of not less than −ck and less than zero (−ck≦L<0).

There is accordingly no abnormal tone or change in hue with respect to the area of the colors that are out of the color range ga of the actual color monitor but satisfy one of the above conditions.

The above embodiment regards the color conversion of the colorimetric values XYZ into the display signals RGB. This conversion is applied to the case in which RGB color signals scanned for color printing are converted into RGB color signals for a color monitor and given to the color monitor.

In case that RGB color signals for the color monitor are converted into CMYK color signals for color printing and given to a printing machine or m case that the RGB color signals for the color monitor are converted into colorimetric values XYZ and recorded on a recording medium, however, the color conversion is carried out in the inverse direction from the display signals RGB into the colorimetric values XYZ.

In this case, the program carries out the RGB-to-r'g'b' conversion, which is the inverse of the r'g'b'-to-RGB conversion executed at step S22 in the flowchart of FIG. 1, and subsequently carries out the r'g'b'-to-XYZ conversion, which is the inverse of the XYZ-to-r'g'b' conversion executed at step S20 in the flowchart of FIG. 1.

Figure 16:
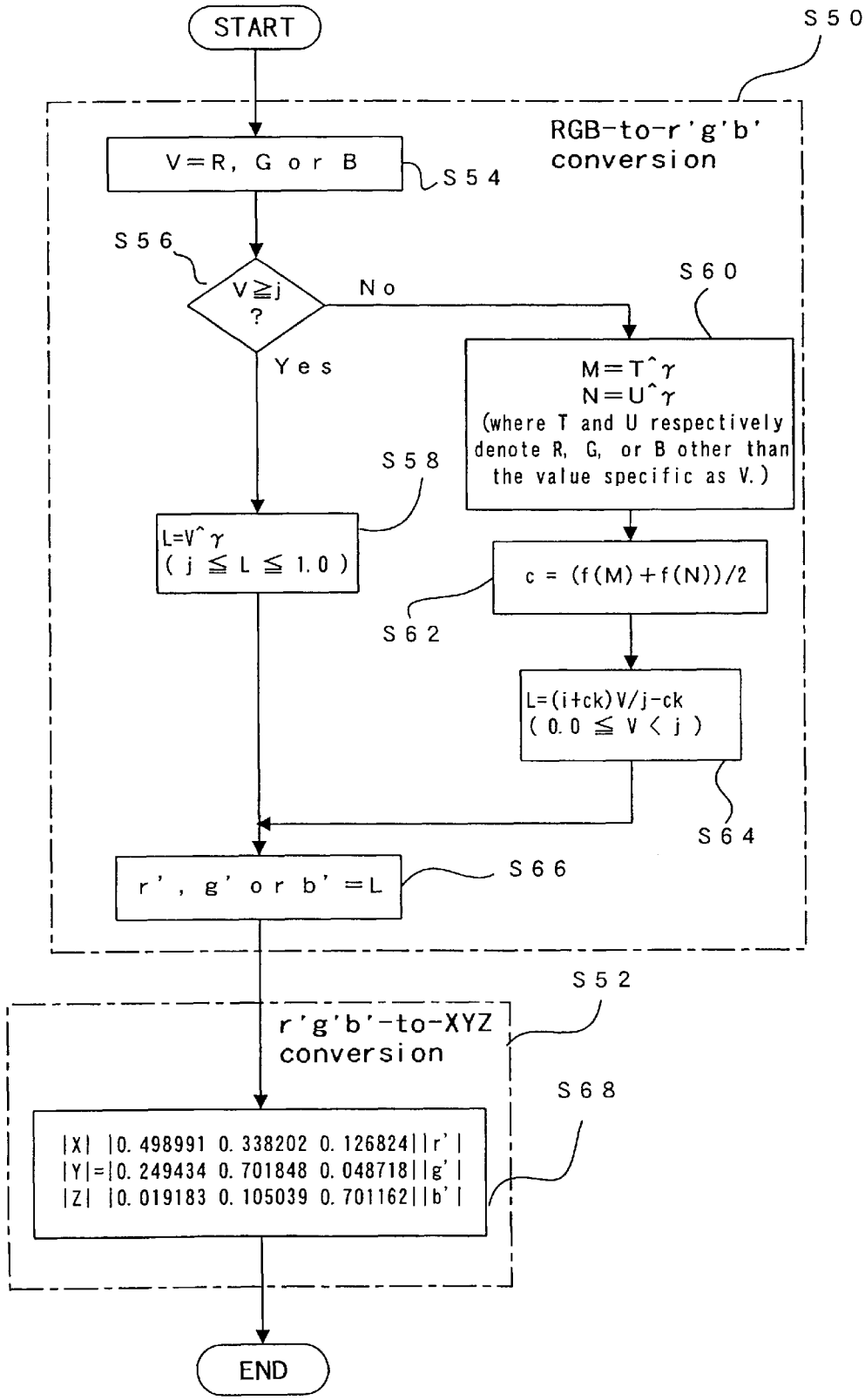
FIG. 16 is a flowchart showing another color conversion routine as a second embodiment according to the present invention.

FIG. 16 is a flowchart showing another color conversion routine as a second embodiment according to the present invention.

When the program enters the color conversion routine of the second embodiment shown in the flowchart of FIG. 16, the red, green, and blue display signals R, G, and B are first converted into luminance-linear values r', g', and b' of red, green, and blue at step S50. Whereas the r'g'b'-to-RGB conversion at step S22 of the first embodiment converts L into V, the RGB-to-r'g'b' conversion at step S50 of the second embodiment inversely converts V into L.

In accordance with a concrete procedure, one of the values R, G, and B is set to V at step S54 and it is determined whether or not the value V is not less than j at step S56. The values R, G, and B are respectively within the range of not less than 0 and not greater than 1.

In case that the value V is less than j at step S56, the program proceeds to step S60, at which values M and N are calculated according to Equations (15) given below:

$$M=T^{\gamma}$$
$$N=U^{\gamma} \tag{15}$$

where T and U denote values other than V set at step S54 among the values R, G, and B. By way of example, when the value R is set to V at step S54, T and U respectively denote the values G and B.

The conversion functions expressed by Equations (15) are the inverse of the conventional conversion functions expressed by Equations (2). When T and U respectively denote the values G and B, for example, Equations (15) give provisional values g' and b' as M and N.

At subsequent step S62, a value c is calculated from the values M and N obtained at step S60 according to Equation (11) given above. The program then converts V into L using the calculated value c according to a conversion function expressed by Equation (16) given below at step S64:

$$L=\frac{(i+ck)}{j}-ck \quad (0.0 \le V < j) \tag{16}$$

In case that the value V is not less than j at step S56, on the other hand, the program converts V into L according to a conversion function expressed by Equation (17) given below at step S58:

$$L=V^{\gamma} \ (j \leqq V \leqq 1.0) \tag{17}$$

The r'g'b'-to-RGB conversion of the first embodiment converts L into V based on the conversion characteristics shown in FIGS. 12 and 13. The conversion characteristics enable each fixed value c to specify one curve C1 as clearly shown in FIG. 13, and thus determine the value V unequivocally corresponding to the value L. The inverse conversion unequivocally determines the value L corresponding to the value V when the value c is fixed. The conversion characteristics shown in FIGS. 12 and 13 are accordingly applied to the RGB-to-r'g'b' conversion of the second embodiment, which converts V into L.

After the conversion into the value L at either step S58 or step S64, the program proceeds to step S66 to set the value L to one of the values r', g', and b' corresponding to the one of the display signals R, G, and B selected at step S54.

In this manner, the RGB-to-r'g'b' conversion of step S50 converts the display signals R, G, and B of red, green, and blue respectively into the values r', g', and b'.

At subsequent step S52, color conversion is further carried out to convert the values r', g', and b' obtained at step S50 into the colorimetric values X, Y, and Z.

While the XYZ-to-r'g'b' conversion of the first embodiment is implemented according to the operation shown by Equation (10), the r'g'b'-to-XYZ conversion executed at step S52 of the second embodiment is implemented at step S68 according to the operation shown by Equation (9), which is an inverse matrix of Equation (10).

In the above manner, the second embodiment converts the display signals RGB into the colorimetric values XYZ.

Figure 17:
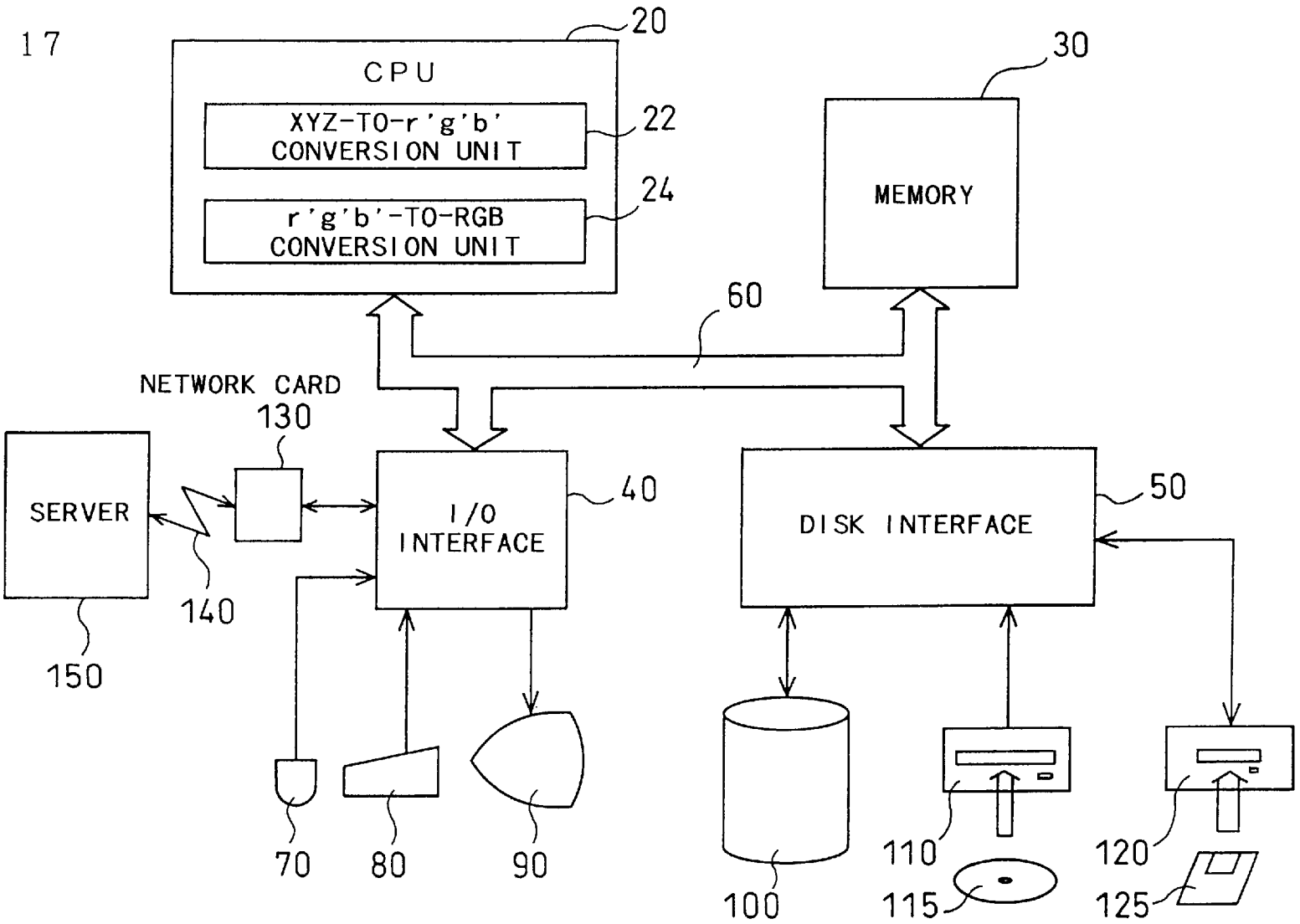
FIG. 17 is a block diagram illustrating a color conversion apparatus which can realize the color conversion method of the first embodiment shown in the flowchart of FIG. 1.

The color conversion method of the first embodiment shown in the flowchart of FIG. 1 is realized by a color conversion apparatus as shown in FIG. 17.

FIG. 17 is a block diagram illustrating a color conversion apparatus which can realize the color conversion method of the first embodiment shown in the flowchart of FIG. 1. The color conversion apparatus shown in FIG. 17 mainly includes a CPU 20, a memory 30, an I/O interface 40, and a disk interface 50, which are mutually connected via a bus 60.

A mouse 70, a keyboard 80, a color monitor 90, and a network card 130 are connected to the I/O interface 40. The I/O interface 40 functions to transmit the instructions and commands input from the mouse 70 and the keyboard 80 to the CPU 20, to give display signals to the color monitor 90, and to transmit communication data to and from the network card 130. The network card 130 is further connected to a network line 140 and communicates, for example, with a server 150 via the network line 140.

A hard disk drive 100, a CD-ROM drive 110, and a floppy disk drive 120 are connected to the disk interface 50. The disk interface 50 functions to read and write data from and into a hard disk incorporated in the hard disk drive 100, to read programs and data from a CD-ROM 115 inserted in the CD-ROM drive 110, and to read and write data from and into a floppy disk 125 inserted in the floppy disk drive 120.

The CPU 20 operates according to computer programs stored in the memory 30 and functions as an XYZ-to-r'g'b' conversion unit 22 and an r'g'b'-to-RGB conversion unit 24. The XYZ-to-r'g'b' conversion unit 22 mainly carries out the XYZ-to-r'g'b' conversion process of step S20 shown in the flowchart of FIG. 1, whereas the r'g'b'-to-RGB conversion unit 24 mainly carries out the r'g'b'-to-RGB conversion process of step S22 shown in the flowchart of FIG. 1. Data of the colorimetric values XYZ, which are subjected to color conversion, are stored in advance in the hard disk incorporated in the hard disk drive 100 and transmitted from the hard disk to the CPU 20. The data of the colorimetric values XYZ are otherwise stored in the server 150 and transmitted from the server 150 to the CPU 20 via the network line 140 and the network card 130. Data obtained in the course of the processing are temporarily stored in the memory 30 or the hard disk. Data of the display signals RGB obtained by the color conversion are stored in the hard disk or in the server 150. When the color monitor 90 is a target color monitor, the resulting display signals RGB may be given to the color monitor 90 for monitoring.

The computer programs which cause the CPU 20 to function as the XYZ-to-r'g'b' conversion unit 22 and the r'g'b'-to-RGB conversion unit 24 are eventually stored in the memory 30 as mentioned above, but are originally recorded in the CD-ROM 115 or the floppy disk 125. In accordance with one concrete procedure, the computer programs are read from the CD-ROM 115 by the CD-ROM drive 110 or from the floppy disk 125 by the floppy disk drive 120, temporarily written in the hard disk incorporated in the hard disk drive 100, and transmitted to the memory 30.

Available recording media in which the computer programs are recorded include magneto-optic discs, magnetic tapes, IC cards, ROM cartridges, punched cards, prints on which bar codes or other codes are printed, and a variety of other computer readable recording media, as well as the CD-ROMs 115, the floppy disks 125, and the hard disk.

The computer programs recorded in the CD-ROM drive 115 or the floppy disk 125 may be transmitted to the memory 30, or those stored in the server 150 may be transmitted to the memory 30 via the network line 140 or the network card 130. In the latter case, the server 150 functions as a computer program supply apparatus. Although the combination of the network line 140 and the network card 130 is used as the communication means to the server in the first embodiment, other combinations, such as a combination of a public network and a modem or a terminal adapter, may also be applicable.

The structure of the first embodiment carries out the XYZ-to-r'g'b' color conversion based on the relationship of color conversion obtained for the virtual color monitor and subsequently performs the r'g'b'-to-RGB conversion by the processing of step S22 shown in the flowchart of FIG. 1. The XYZ-to-r'g'b' color conversion may, however, be based on the relationship of color conversion obtained for the actual color monitor as discussed below.

Figure 18:
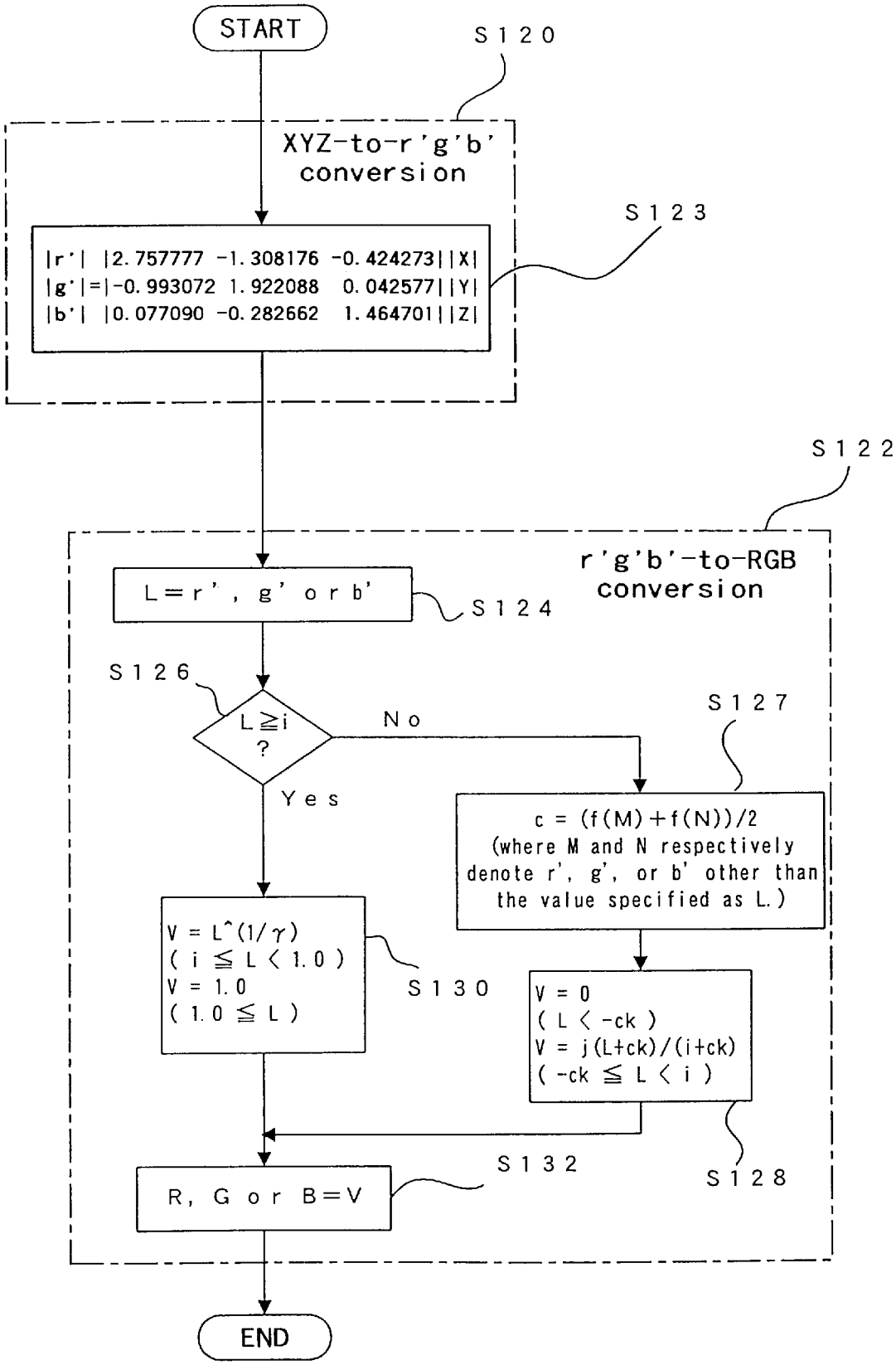
FIG. 18 is a flowchart showing still another color conversion routine as a third embodiment according to the present invention.

FIG. 18 is a flowchart showing still another color conversion routine as a third embodiment according to the present invention.

When the program enters the color conversion routine of the third embodiment shown in the flowchart of FIG. 18, the colorimetric values X, Y, and Z are first converted to the values r', g', and b' at step S120. Here the XYZ-to-r'g'b' color conversion is based on the relationship of color conversion for the actual color monitor.

In accordance with a concrete procedure, the XYZ-to-r'g'b' conversion process of step S120 converts the colorimetric values X, Y, and Z into the values r', g', and b' according to the operation shown by Equation (1) at step S123.

The program subsequently converts the values r', g', and b' obtained at step S120 into red, green, and blue display signals R, G, and B to be input into the actual color monitor at step S122.

The processing of steps S124 through S132 included in step S122 in the flowchart of FIG. 18 is identical with the processing of steps S24 through S32 included in step S22 in the flowchart of FIG. 1 and is thus not specifically described here.

Figure 19:
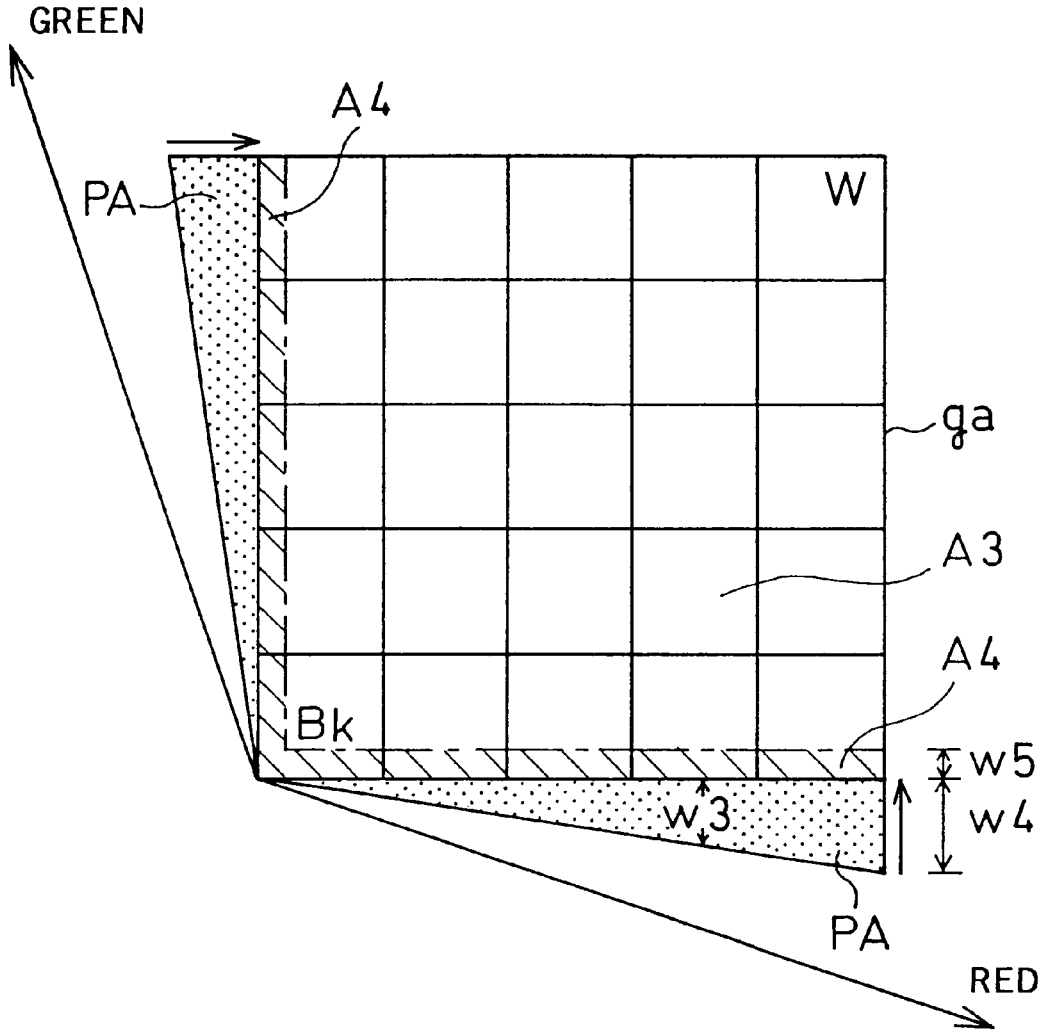
FIG. 19 shows a color range relievable by the color conversion method of the third embodiment and positional changes of the respective colors before and after the conversion.

FIG. 19 shows a color range relievable by the color conversion method of the third embodiment and positional changes of the respective colors before and after the conversion. In other words, FIG. 19 shows a three-dimensional color space projected on the red-green plane, like the diagrams of FIGS. 4 and 14. In the diagram of FIG. 19, the area put between the axis of red direction and the axis of green direction (that is, two arrows) represents the area in which colors actually exist. A solid rectangle latticed by the solid lines denotes the color range or the gamut ga reproducible by the fluorescent materials of red, green, and blue in the actual color monitor.

Referring to FIG. 19, the processing of step S130 in the r'g'b'-to-RGB conversion process shown in the flowchart of FIG. 18 converts the colors existing in a conversion area A3 expressed by a latticed rectangle of the one-dot chain line among the colors included in the color range ga into the colors within the conversion area A3.

The processing of step S128 in the r'g'b'-to-RGB conversion process shown in the flowchart of FIG. 18 converts the colors that are out of the color range ga of the actual color monitor but within a dotted area PA into the colors within a conversion area A4 filled with the slant lines in the color range ga of the actual color monitor. The dotted area PA accordingly represents the area relieved by the r'g'b'-to-RGB conversion of this embodiment. The colors in the dotted relievable area PA are converted into the colors in the conversion area A4.

The processing of step S128 converts the colors existing in the conversion area A4 among the colors included in the color range ga as well as those in the relievable area PA into the colors within the conversion area A4.

The relievable area PA corresponds to the values L of not less than −ck and less than 0 shown in the graph of FIG. 13 and has a width w3 equal to ck. Since the value c is varied according to Equations (11) and (13), the width w3 of the relievable area PA is varied in the following manner. Here it is assumed that the value r' is set to L. When f(g')=0 and f(b')=0, the value c is equal to 0, so that the width w3 takes the minimum value 0. When f(g')=1 and f(b')=1, the value c is equal to 1, so that the width w3 takes the maximum value k. When f(g')=g' and f(b')=b', the value c is equal to (g'+b')/2, so that the width w3 is equal to (g'+b')k/2. In this case, the width w3 is proportional to the values g' and b'. The width w3 of the relievable area PA with respect to the red direction is linearly widened with increases in values of green and blue (g',b'), where the blue direction is perpendicular to the sheet surface of FIG. 19.

The width w3 of the relievable area PA has a maximum width w4, which corresponds to the value L=k as shown in FIG. 13. A width w5 of the conversion area A4 corresponds to the value V=j as shown in FIG. 13. The width of one side of the color range ga corresponds to the value L=1 or V=1. Since the value k is set equal to 0.1 and the value j equal to 0.03 in this embodiment, the width w5 of the conversion area A4 is narrower than the maximum width w4 of the relievable area PA.

The colors located in a part of the relievable area PA having the width w3 greater than the width w5 of the conversion area A4 are converted in the contracted manner into the conversion area A4 of the narrower width by the r'g'b'-to-RGB conversion. The colors located in the remaining part of the relievable area PA having the width w3 narrower than the width w5 of the conversion area A4 are, on the other hand, converted in the expanded manner into the conversion area A4 of the greater width. The former colors have the chromaticity points densely dispersed in the conversion area A4, whereas the latter colors have the chromaticity points sparsely dispersed in the conversion area A4.

The colors existing in the conversion area A3 among the colors originally included in the color range ga are converted into the colors within the conversion area A3 by the r'g'b'-to-RGB conversion. There are thus substantially no positional shifts of colors (shifts of chromaticity points) before and after the conversion with respect to these colors.

In the diagram of FIG. 19, a wide-angle area other than the narrow-angle area put between the axis of red direction and the axis of green direction (two arrows) represents the area in which colors do not actually exist. In this embodiment, the relievable area PA is not included at all in this wide-angle area. Colors thus actually exist in the conversion area A4, into which the colors in the relievable area PA are converted by the r'g'b'-to-RGB conversion.

As described above, the colorimetric values XYZ converted by the method of this embodiment include the colors that are out of the color range or the gamut ga reproducible by the fluorescent materials of red, green, and blue in the actual color monitor. Even when one of the values r', g', and b' obtained by the conversion is less than zero (L<0), as long as the value is not less than −ck (L≧−ck), the resulting converted value R, G, or B is not less than 0 and less than j (0≦V<j). Information is not lost but is kept as the resulting values R, G, and B, with respect to the colors that are out of the color range ga of the actual color monitor but have the values r', g', and b' of not less than −ck and less than zero (−ck≦L<0). There is accordingly no abnormal tone or change in hue with respect to the area of the colors that are out of the color range ga of the actual color monitor but satisfy the above condition.

The color conversion method of the third embodiment shown in the flowchart of FIG. 18 can be realized by the color conversion apparatus shown in FIG. 17, like the first embodiment shown in FIG. 1.

The third embodiment regards the color conversion of the colorimetric values XYZ into the display signals RGB. Like the second embodiment discussed previously, however, the color conversion may be carried out in the inverse direction from the display signals RGB into the colorimetric values XYZ.

In this case, the program carries out the RGB-to-r'g'b' conversion, which is the inverse of the r'g'b'-to-RGB conversion executed at step S122 in the flowchart of FIG. 18, and subsequently carries out the r'g'b'-to-XYZ conversion, which is the inverse of the XYZ-to-r'g'b' conversion executed at step S120 in the flowchart of FIG. 18.

Figure 20:
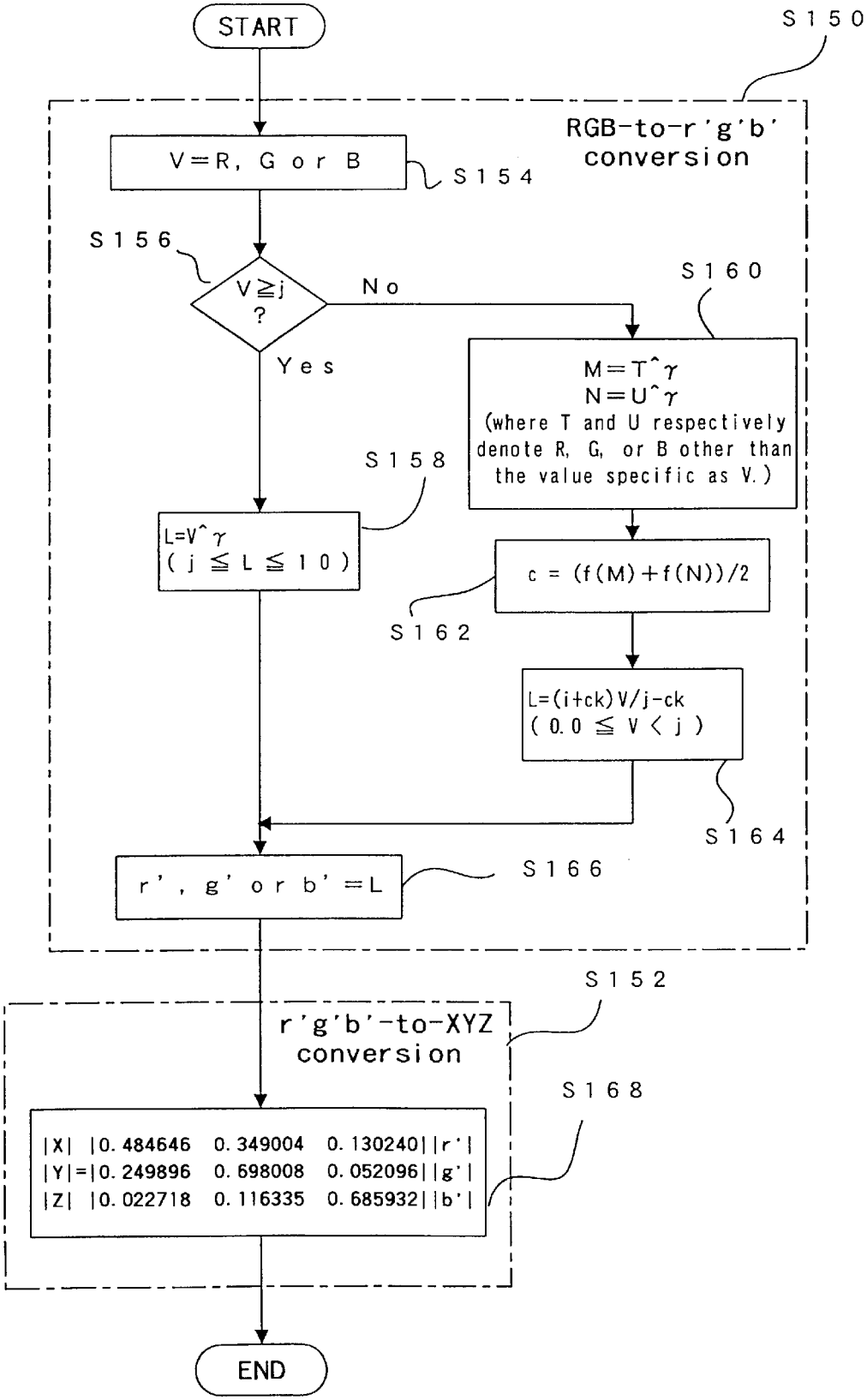
FIG. 20 is a flowchart showing another color conversion routine as a fourth embodiment according to the present invention.

FIG. 20 is a flowchart showing another color conversion routine as a fourth embodiment according to the present invention.

When the program enters the color conversion routine of the fourth embodiment shown in the flowchart of FIG. 20, the red, green, and blue display signals R, G, and B are first converted into luminance-linear values r', g', and b' of red, green, and blue at step S150. Whereas the r'g'b'-to-RGB conversion at step S122 of the third embodiment converts L into V, the RGB-to-r'g'b' conversion at step S150 of the fourth embodiment inversely converts V into L.

The processing of steps S154 through S166 included in step S150 in the flowchart of FIG. 20 is identical with the processing of steps S54 through S66 included in step S50 in the flowchart of FIG. 16 and is thus not specifically described here.

At subsequent step S152, color conversion is further carried out to convert the values r', g', and b' obtained at step S150 into the colorimetric values X, Y, and Z.

While the XYZ-to-r'g'b' conversion of the third embodiment is implemented according to the operation shown by Equation (1), the r'g'b'-to-XYZ conversion executed at step S152 of the fourth embodiment is implemented at step S168 according to the operation shown by Equation (8), which is an inverse matrix of Equation (1).

In the above manner, the fourth embodiment converts the display signals RGB into the colorimetric values XYZ.

In the first and the third embodiments discussed above, the colorimetric values XYZ are converted into the display signals RGB according to the color conversion method of FIG. 1 and the color conversion method of FIG. 18, respectively. The display signals RGB (RGB color signals) obtained by the color conversion method shown in either the flowchart of FIG. 1 or the flowchart of FIG. 18 may further be converted to print signals CMYK (CMYK color signals) and given to a printing machine or an image recording apparatus for process. Since the color conversion method of either FIG. 1 or FIG. 18 can be realized by the color conversion apparatus of FIG. 17 as described above, the display signals RGB obtained by the color conversion method of either FIG. 1 or FIG. 18 are equivalent to the display signals RGB obtained by the color conversion apparatus of FIG. 17.

Figure 21:
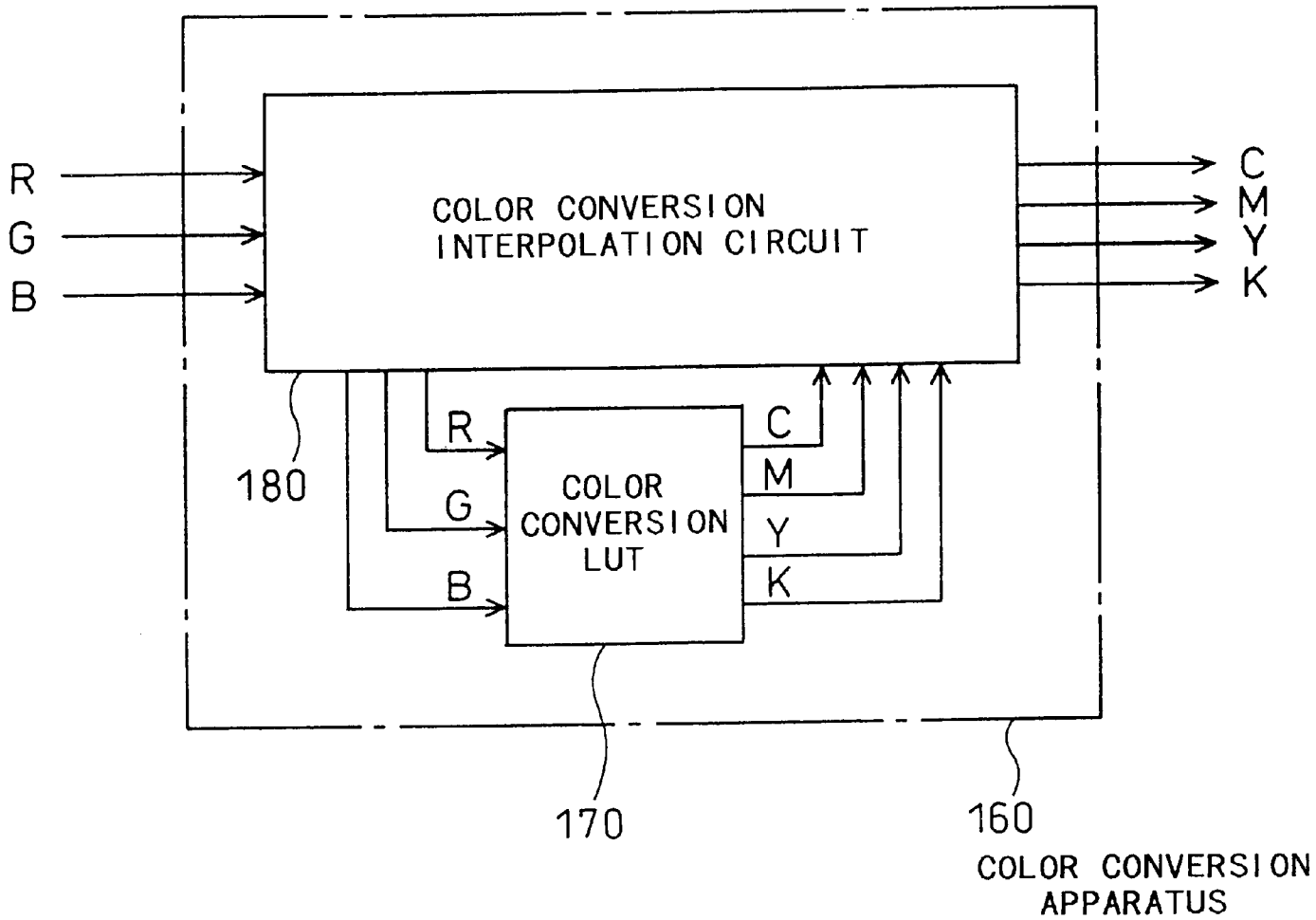
FIG. 21 is a block diagram illustrating a color conversion apparatus 160 as a fifth embodiment according to the present invention.

The further color conversion of the display signals RGB obtained by the color conversion apparatus of FIG. 17 into the print signals CMYK may be implemented by a color conversion apparatus shown in FIG. 21.

FIG. 21 is a block diagram illustrating a color conversion apparatus 160 as a fifth embodiment according to the present invention. The color conversion apparatus 160 of the fifth embodiment includes a color conversion look-up table 170 and a color conversion interpolation circuit 180.

The display signals RGB obtained by the color conversion apparatus of FIG. 17 are input into the color conversion apparatus 160 shown in FIG. 21. In case that a specific combination of R, G, and B input into the color conversion apparatus 160 exists as an address in the color conversion look-up table 170, the color conversion interpolation circuit 180 inputs the specific combination of R, G, and B into the color conversion look-up table 170. The corresponding C, M, Y, and K values stored at the address specified by the specific combination of R, G, and B input from the color conversion interpolation circuit 180 are read from the color conversion look-up table 170 and output to the color conversion interpolation circuit 180. The color conversion interpolation circuit 180 then outputs the values C, M, Y, and K thus obtained.

In case that the specific combination of R, G, and B input into the color conversion apparatus 160 does not exist as an address in the color conversion look-up table 170, on the other hand, the color conversion interpolation circuit 180 selects a plurality of possible combinations of R, G, and B, which exist as a plurality of addresses in the color conversion look-up table 170 and are close to the specific combination of R, G, and B, and inputs the possible combinations into the color conversion look-up table 170. Plural sets of the corresponding C, M, Y, and K values stored at the plurality of addresses specified respectively by the possible combinations of R, G, and B input from the color conversion interpolation circuit 180 are read from the color conversion look-up table 170 and output to the color conversion interpolation circuit 180. The color conversion interpolation circuit 180 performs interpolation with the plural sets of C, M, Y, and K values thus obtained and outputs the values C, M, Y, and K corresponding to the specific combination of R, G, and B input into the color conversion apparatus 160.

FIG. 22 shows available combinations of R, G, and B existing as addresses in the color conversion look-up table 170 shown in FIG. 21 and the corresponding values C, M, Y, and K stored at the addresses. By way of example, (R,G,B)=(0,0,8) is input as the specific combination of R, G, and B from the color conversion interpolation circuit 180 into the color conversion look-up table 170. The corresponding values C, M, Y, and K stored at the address specified by the specific combination of R, G, and B, that is, (C,M,Y,K)=($C_2$,$M_2$,$Y_2$,$K_2$) shown in FIG. 22, are output to the color conversion interpolation circuit 180. The C, M, Y, and K values are stored at all the addresses in the color conversion look-up table 170 as shown in FIG. 22.

When the r'g'b'-to-RGB conversion performed by the r'g'b'-to-RGB conversion unit 24 of the color conversion apparatus shown in FIG. 17 is based on the conversion characteristics shown in FIGS. 12 and 13, for example, the addresses in the color conversion look-up table 170 should include the combinations of R, G, and B including j as at least one of the values R, G, and B.

For example, when j is set equal to 8, the addresses in the color conversion look-up table 170 should include the combinations of R, G, and B including 8 as at least one of the values R, G, and B. In the example shown in FIG. 22, the combinations of R, G, and B including 8 as at least one of the values R, G, and B, for example, (R,G,B)=(0,0,8), (R,G,B)=(0,8,0), (R,G,B)=(8,0,0), (R,G,B)=(0,8,8), (R,G,B)=(8,0,8), (R,G,B)=(8,8,0), and (R,G,B)=(8,8,8), exist as the addresses in the color conversion look-up table 170.

The C, M, Y, and K values are stored at all the addresses in the color conversion look-up table 170 constructed as discussed above. Namely the C, M, Y, and K values corresponding to the combinations of R, G, and B, which include j as at least one of the values R, G, and B and exist as addresses, actually exist in the color conversion look-up table 170.

The tendency of conversion in the r'g'b'-to-RGB conversion process is drastically changed before and after the point R, G, or B=j (that is, V=j) as clearly understood from the conversion characteristics shown in FIGS. 12 and 13. The tendency of conversion in the RGB-to-CMYK conversion process is also drastically changed before and after the point R, G, or B=j. The plural sets of the C, M, Y, and K values corresponding to the possible combinations that are close to the input combination of R, G, and B including j (that is, the C, M, Y, and K values obtained by the RGB-to-CMYK conversion) are accordingly not continuous.

It is here assumed that the addresses in the color conversion look-up table 170 do not include the combinations of R, G, and B including j, and the C, M, Y, and K values corresponding to the combinations of R, G, and B do not actually exist in the color conversion look-up table 170. When a specific combination of R, G, and B including j is input into the color conversion apparatus 160, plural sets of the C, M, Y, and K values corresponding to possible combinations of R, G, and B that are close to the specific combination of R, G, and B are read from the color conversion look-up table 170 and used for interpolation. As mentioned above, however, the plural sets of the C, M, Y, and K values corresponding to the possible combinations close to the specific combination of R, G, and B including j are not continuous. The interpolation with such discontinuous C, M, Y, and K values does not give the appropriate set of the C, M, Y, and K values corresponding to the specific combination of R, G, and B including j.

In this embodiment, on the other hand, the addresses in the color conversion look-up table 170 include the combinations of R, G, and B including j, and the C, M, Y, and K values corresponding to the combinations of R, G, and B actually exist in the color conversion look-up table 170. When a specific combination of R, G, and B including j is input into the color conversion apparatus 160, the C, M, Y, and K values corresponding to the specific combination of R, G, and B are read from the color conversion look-up table 170 without interpolation. This structure gives the appropriate set of the C, M, Y, and K values corresponding to the specific combination of R, G, and B including j.

The present invention is not restricted to the above embodiments or their modifications, but there may be many other modifications, changes, and alterations without departing from the scope or spirit of the main characteristics of the present invention.

The conversion characteristics of L into V used in the process of r'g'b'-to-RGB conversion include a linear portion (that is, the linear function of L) in the range of V of not less than 0 and less than j as shown by the dashed curve in the graphs of FIGS. 12 and 13. Any monotonic increasing function other than the linear function of L may, however, be applied for the conversion of L into V.

In the embodiments discussed above, the display signals RGB are given to the color monitor. The principle of the present invention is, however, not restricted to the color monitors, but may be applicable to other color display devices, such as color liquid-crystal displays and color plasma displays.

It should be clearly understood that the above embodiments are only illustrative and not restrictive in any sense. The scope and spirit of the present invention are limited only by the terms of the appended claims.

What is claimed is:

1. A method of converting colorimetric values representing a composite color into display signals that are to be input into a target color display device to reproduce the composite color, the display signals being related to mixing quantities of device primary colors in a color mixture, the device primary colors being single-color components reproduced by respective single-color elements of the target color display device, the composite color being reproduced by the target color display device as a mixture of the device primary colors mixed in quantities according to the display signals, the target color display device having a reproducible range of the mixing quantity for each of the device primary colors, the method comprising:

(a) defining a definition range of intensities of the display signals which are to be converted in the target color display device to the mixing quantities of the device primary colors within the reproducible range, the definition range being divided into a first conversion range and a second conversion range;

(b) converting the colorimetric values for the composite color into the mixing quantities of the device primary colors according to a first conversion relation; and (c) converting the mixing quantities of the device primary colors into the intensities of the display signals according to a second conversion relation, comprising:

(i) determining a defined relievable range for at least one selected device primary color among the device primary colors as a function of the mixing quantities of the remaining device primary colors other than the selected device primary color, the relievable range being out of and adjacent to the reproducible range and within a predetermined maximum relievable range; wherein (ii) when the mixing quantity of the selected device primary color is within the reproducible range, converting the mixing quantity of the selected device primary color into the intensity of the display signal within the first conversion range; and (iii) when the mixing quantity of the selected device primary color is within the relievable range, converting the mixing quantity of the selected device primary color into the intensity of the display signal within the second conversion range; wherein:

the relievable range is determined so that an extent of the relievable range increases as the mixing quantities of the remaining device primary colors increases; and a ratio of the second conversion range to the definition range is smaller than a ratio of the reproducible range to the maximum relievable range.

2. A method in accordance with claim 1, wherein the relievable range is determined only when the mixing quantity of the selected device primary color is out of the reproducible range.

3. A method in accordance with claim 1, wherein the step (c) further comprises the steps of:

providing first and second functions usable to represent the second conversion relation, the second function being adjustable by the mixing quantities of the remaining device primary colors;

selecting the first function to represent the second conversion relation when the mixing quantity of the selected device primary color is within the reproducible range; and selecting the second function to represent the second conversion relation when the mixing quantity of the selected device primary color is within the maximum relievable range.

4. A method in accordance with claim 1, wherein the first conversion relation used in the step (b) represents conversion from the colorimetric values to mixing quantities of virtual device primary colors of a virtual color display device, the virtual color display device having virtual single-color elements reproducing virtual single-color components associated with the single-color components reproduced by the single-color elements of the target color display device, respectively, wherein at least one selected virtual single-color component is determined so that the selected virtual single-color component has an identical hue with that of the associated single-color component and a higher saturation than that of the associated single-color component.

5. A method in accordance with claim 4, wherein the selected virtual single-color component corresponds to a first chromaticity point in a chromaticity diagram of a uniform color space coordinate system and the associated single-color component corresponds to a second chromaticity point in the chromaticity diagram, the first chromaticity point being determined to be present on a straight line that connects an achromatic color point with the second chromaticity point.

6. A method in accordance with claim 4, wherein all of the virtual single-color components are determined so that each of the virtual single-color components has an identical hue with that of the associated single-color component and a higher saturation than that of the associated single-color component by a ratio common to all of the virtual single-color components.

* * * * *